US007084102B1

(12) United States Patent
Arnau et al.

(10) Patent No.: US 7,084,102 B1
(45) Date of Patent: Aug. 1, 2006

(54) PERFUMED DETERGENT TABLET

(75) Inventors: José Arnau, Montigny le Bretonneux (FR); Philip Andrew Cunningham, Newcastle upon Tyne (GB); Michael Green, Newcastle u. Tyne (GB); Allan Campbell McRitchie, Tyne & Wear (GB)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/914,494

(22) PCT Filed: Mar. 8, 2000

(86) PCT No.: PCT/US00/05985

§ 371 (c)(1),
(2), (4) Date: Aug. 29, 2001

(87) PCT Pub. No.: WO00/55294

PCT Pub. Date: Sep. 21, 2000

(30) Foreign Application Priority Data

Mar. 12, 1999 (EP) ..... 99870043
Apr. 30, 1999 (EP) ..... 99870082

(51) Int. Cl.
*C11D 17/00* (2006.01)
*C11D 3/50* (2006.01)
*C11D 3/36* (2006.01)

(52) U.S. Cl. ..... 510/446; 510/441; 510/294; 510/298; 510/469; 510/480; 510/507

(58) Field of Classification Search ..... 510/446, 510/294, 298, 441, 469, 480, 507
See application file for complete search history.

(56) References Cited

U.S. PATENT DOCUMENTS

| | | | | |
|---|---|---|---|---|
| 4,269,723 | A * | 5/1981 | Barford et al. | 510/191 |
| 4,460,490 | A | 7/1984 | Barford et al. | 510/192 |
| 4,678,593 | A * | 7/1987 | Ridley | 510/147 |
| 5,205,955 | A * | 4/1993 | Bunczk et al. | 510/191 |
| 5,780,410 | A * | 7/1998 | Baillely et al. | 510/220 |
| 6,007,735 | A * | 12/1999 | Creed | 252/186.25 |
| 6,096,703 | A * | 8/2000 | Hall | 510/441 |
| 6,440,926 | B1 * | 8/2002 | Spadoni et al. | 510/445 |
| 6,489,279 | B1 * | 12/2002 | Convents et al. | 510/226 |
| 6,630,438 | B1 * | 10/2003 | Arnau et al. | 510/439 |

FOREIGN PATENT DOCUMENTS

| | | |
|---|---|---|
| EP | 0 846 754 A1 | 6/1998 |
| EP | 0 846 755 A1 | 6/1998 |
| EP | 0 846 756 A1 | 6/1998 |
| EP | 1 026 227 A1 | 8/2000 |
| EP | 1 026 228 A1 | 8/2000 |
| EP | 1 026 229 A1 | 8/2000 |
| GB | 1 307 387 | 2/1973 |
| GB | 2061996 A * | 5/1981 |
| WO | WO 95/20030 | 7/1995 |
| WO | WO 97/05226 | 2/1997 |
| WO | WO 99/06521 | 2/1999 |
| WO | WO 99/27069 | 6/1999 |
| WO | WO 99/31215 | 6/1999 |
| WO | WO 99/40171 | 8/1999 |

* cited by examiner

*Primary Examiner*—Lorna M. Douyon
(74) *Attorney, Agent, or Firm*—Mark A. Charles; Marianne Dressman; Kim W. Zerby

(57) ABSTRACT

A perfumed detergent tablet comprises a clay mineral compound and a heavy metal ion sequestrant. The clay mineral helps disperse the tablet in aqueous media and acts as a fabric softener for laundered fabrics. The perfume is free of Schiff bases, such as those formed from anthranilates and aldehydes, which can discolor the clay.

11 Claims, No Drawings

PERFUMED DETERGENT TABLET

This application is a 371 of PCT/US00/05985 filed Mar. 8, 2000 which claims priority under 35 USC 119 to European Application Serial Number 99870043.9, filed Mar. 12, 1999 and European Application Serial Number 99870082.7, filed Apr. 30, 1999.

TECHNICAL FIELD OF THE INVENTION

The present invention relates to perfumed detergent tablets, especially those adapted for use in washing machines, and to processes for making such tablets.

BACKGROUND OF THE INVENTION

Perfumed products are well-known in the art. However, consumer acceptance of such perfumed products like laundry and cleaning products is determined not only by the performance achieved with these products but also by the aesthetics associated therewith. The perfume components are therefore an important aspect of the successful formulation of such commercial products.

In addition, a clay mineral compound is a desirable ingredient of such laundry and cleaning product, in particular those products which are in tablet form.

Indeed, the clay can provide softening benefit but can also serve as a disintegrant of such detergent tablets.

However, a problem encountered with perfumed detergent tablets containing a clay mineral compound is that the clay can have a detrimental effect on the performance of the perfume contained therein. Hence, not to be bound by theory, it is believed that due to the close physical proximity given by the tablet, the perfume is absorbed into the clay where it can interact with heavy metal ions and acid or base sites within the clay which as result may cause a discoloration of the clay. Still, the interaction between the perfume and the clay may also result in the tablet having a less attractive odour.

Accordingly, it is an object of the invention to provide a perfumed detergent tablet comprising a clay mineral compound which exhibit good perfume performance with reduced discoloration of the clay.

Further, cleaning compositions in tablet form have often been proposed, however these have not (with the exception of soap bars for personal washing) gained any substantial success, despite the several advantages of products in a unit dispensing form. One of the reasons for this may be that detergent tablets require a relatively complex manufacturing process. In particular, it is often desirable to provide the tablet with a coating and this adds to the difficulties of manufacture.

While tablets without a coating are entirely effective in use, they usually lack the necessary surface hardness to withstand the abrasion that is a part of normal manufacture, packaging and handling. The result is that non-coated tablets suffer from abrasion during these processes, resulting in chipped tablets and loss of active material.

Finally, coating of tablets is often desired for aesthetic reasons, to improve the outer appearance of the tablet or to achieve some particular aesthetic effect.

Numerous methods of tablet coating have been proposed, and many of these have been suggested for detergent tablets. However, all of these methods have certain disadvantages, as will be explained below.

GB-A-0 989 683, published on 22nd Apr. 1965, discloses a process for preparing a particulate detergent from surfactants and inorganic salts; spraying on water-soluble silicate; and pressing the detergent particles into a solid form-retaining tablet. Finally, a readily water-soluble organic film-forming polymer (for example, polyvinyl alcohol) provides a coating to make the detergent tablet resistant to abrasion and accidental breakage.

EP-A-0 002 293, published on 13th Jun. 1979, discloses a tablet coating comprising hydrated salt such as acetate, metaborate, orthophosphate, tartrate, and sulphate.

EP-A-0 716 144, published on 12th Jun. 1996, also discloses laundry detergent tablets with water-soluble coatings which may be organic polymers including acrylic/maleic co-polymer, polyethylene glycol, PVPVA, and sugar.

WO9518215, published on 6th Jul. 1995, provides water-insoluble coatings for solid cast tablets. The tablets are provided with hydrophobic coatings including wax, fatty acid, fatty acid amides, and polyethylene glycol.

EP-A-0 846 754, published on the $10^{th}$ of Jun. 1998, provides a tablet having a coating comprising a dicarboxylic acid, the coating material typically having a melting point of from 40° C. to 200° C.

EP-A-0 846 755, published on the $10^{th}$ of Jun. 1998, provides a tablet having a coating comprising a material insoluble in water at 25° C., such as C12–C22 fatty acids, adipic acid or C8–C13 dicarboxylic acids.

EP-A-0 846 756, published on the $10^{th}$ of Jun. 1998, provides a tablet having a coating comprising a disintegrant material and preferably an effervescent material.

Recently, it has been found means by which coated tablets can be provided with a coating so that they can be stored, shipped and handled without damage, the coating being easily broken when the tablet is in the washing machine, releasing the active ingredients into the wash solution. Typical of such disclosure can be found in pending European patent applications EP 99870017.3, publication date Aug. 9, 2000, EP 99870018.1, publication date Aug. 9, 2000, and EP 99870019.9, publication date Aug. 9, 2000.

However, whilst giving satisfactory results, it has now also been found that where a clay mineral compound is present in the coating of the detergent tablet, the clay, for the same believed reasons stated above, can have a detrimental effect on the performance of the perfume contained therein as well as on the appearance of the coating, i.e. discoloration of the coating.

These problems have further been found more acute overtime, and more particularly where the coating also comprises an acid having a melting point of at least 40° C., more particularly with a melting point of at least 145° C.

Accordingly, the detergent formulator is also faced with the problems of providing a coated tablet having a coating which has satisfactory appearance, is sufficiently hard to protect the tablet from mechanical forces when stored, shipped and handled, and disperses readily in an aqueous solution whilst still giving satisfactory perfume performance.

Further, the perfuming of detergent tablet is a concern to the detergent formulator. Hence, the presence of the coating on the tablet can reduce the diffusion of the perfume from the tablet resulting in a less attractive odour.

It has now surprisingly been found that the addition of a heavy metal ion sequestrant to perfumed detergent tablet overcomes these problems.

SUMMARY OF THE INVENTION

The present invention is a perfumed detergent tablet, the coating comprising a clay mineral compound and a heavy metal ion sequestrant.

By "perfumed detergent tablet", it is meant that the perfume can be present in the coating if present, or in the detergent composition, or both.

DETAILED DESCRIPTION OF THE INVENTION

Clay

An essential ingredient of the detergent tablet is a clay. The clay may be present in any of the detergent composition, the coating if present, or both.

By clay mineral compound (or in abbreviation, "clay"), it is meant herein a hydrous phyllosilicate, typically having a two or three layer crystal structure. For clarity, it is noted that the term clay mineral compound, as used herein, excludes sodium aluminosilicate zeolite builder compounds, which however, may be included in the compositions of the invention as optional components. Further description of clays may be found in Kirk-Othmer, Encyclopaedia of Chemical Technology, 4th edition, Volume 6, page 381, as published by John Wiley and Sons.

The clay mineral compound is preferably a smectite clay compound. Smectite clays are disclosed in the U.S. Pat. Nos. 3,862,058, 3,948,790, 3,954,632 and 4,062,647 and European Patents No.s EP-A-299,575 and EP-A-313,146 all in the name of the Procter and Gamble Company.

The term smectite clays herein includes both the clays in which aluminium oxide is present in a silicate lattice and the clays in which magnesium oxide is present in a silicate lattice. Typical smectite clay compounds include the compounds having the general formula $A_{12}(Si_2O_5)_2(OH)_2.nH_2O$ and the compounds having the general formula $Mg_3(Si_2O_5)_2(OH)_2.nH_2O$. Smectite clays tend to adopt an expandable three layer structure.

Specific examples of suitable smectite clays include those selected from the classes of the montmorillonites, hectorites, volchonskoites, nontronites, saponites and sauconites, particularly those having an alkali or alkaline earth metal ion within the crystal lattice structure. Sodium or calcium montmorillonite are particularly preferred.

Suitable smectite clays, particularly montmorillonites, are sold by various suppliers including English China Clays, Laviosa, Fordamin, Georgia Kaolin and Colin Stewart Minerals (CSM).

Preferred smectite clays are sold under the tradename of White Bentonite STP by Fordamin and Detercal P7 by Laviosa Chemical Mineria SPA.

Clays for use herein may be subjected to an acid washing treatment with any suitable mineral or organic acid. Such clays give rise to an acid pH on dissolution in distilled water. A commercially available "acid clay" of this type is sold under the tradename Tonsil P by Sud Chemie AG.

Substitution of small cations, such as protons, sodium ions, potassium ions, magnesium ions and calcium ions, and of certain organic molecules including those having positively charged functional groups can typically take place within the crystal lattice structure of the smectite clays. A clay may be chosen for its ability to preferentially absorb one cation type, such ability being assessed by measurements of relative ion exchange capacity. The smectite clays suitable herein typically have a cation exchange capacity of at least 50 meq/100 g. U.S. Pat. No. 3,954,632 describes a method for measurement of cation exchange capacity.

The crystal lattice structure of the clay mineral compounds may have, in a preferred execution, a cationic fabric softening agent substituted therein. Such substituted clays have been termed 'hydrophobically activated' clays. The cationic fabric softening agents are typically present at a weight ratio, cationic fabric softening agent to clay, of from 1:200 to 1:10, preferably from 1:100 to 1:20. Suitable cationic fabric softening agents include the water insoluble tertiary amines or dilong chain amide materials as disclosed in GB-A-1 514 276 and EP-B-0 011 340.

A preferred commercially available "hydrophobically activated" clay is a bentonite clay containing approximately 40% by weight of a dimethyl ditallow quaternary ammonium salt sold under the tradename Claytone EM by English China Clays International.

Preferably, the clay which is present in the detergent composition is present in an intimate mixture or in a particle with a humectant and a hydrophobic compound, preferably a wax or oil, such as paraffin oil. Preferred humectants are organic compounds, including propylene glycol, ethylene glycol, dimers or trimers of glycol, most preferably glycerol. The particle is preferably an agglomerate. Alternatively, the particle may be such that the wax or oil and optionally the humectant form an encapsulate on the clay or alternatively, the clay be an encapsulate for the wax or oil and the humectant. It may be preferred that the particle comprises an organic salt or silica or silicate.

In another embodiment, the clay in the detergent composition is preferably mixed with one or more surfactants and optionally builders and optionally water, in which case the mixture is preferably subsequently dried. Preferably, such a mixture is further processed in a spray-drying method to obtain a spray dried particle comprising the clay.

It may also be preferred that the intimate mixture comprises a chelating agent.

Depending on its end use, the clay will preferably be present in different particles size. Hence, when softening is desired, it is preferred that at least 50% by weight, preferably substantially all (e.g. at least 90% or 95%) by weight of the clay is present as granules. By granules, it is meant that the particles of the clay mineral compound which is present in the detergent composition are included as components of agglomerate particles optionally containing other detergent compounds. Where present as such components, the term "largest particle dimension" of the clay mineral compound refers to the largest dimension of the clay mineral component as such, and not to the agglomerated particle as a whole. Typically, the granules will have a particle size of at least 100 micrometers, generally 100–1700 micrometers.

When a coating is present, it is often desired to have a clay as disintegrant in the coating. In this instance, the clay is preferably present in the coating, having a particle size of less than 75 μm, more preferably of less than 53 μm.

Preferably, the tablet is a softening tablet. By softening tablet, it is meant that the level of clay will typically be of at least 5%, preferably at least 8%, and most preferably at least 10% by weight of the tablet. The amount may be less than 25%, usually less than 20%, and preferably not more than 15% by weight of the tablet.

Heavy Metal Ions Sequestrants

The detergent compositions tablet of the invention also contains a heavy metal ion sequestrant, that being either present in the coating if present or in the detergent composition, or even in both the coating and the detergent composition, preferably, it is present in both the coating and the detergent composition or only in the detergent composition. By heavy metal ion sequestrant, it is meant herein components which act to sequester (chelate) heavy metal ions. These components may also have calcium and magnesium chelation capacity, but preferentially they show selectivity to binding heavy metal ions such as iron, manganese and copper.

Heavy metal ion sequestrants are generally present at a level of from 0.005% to 20%, preferably from 0.1% to 10%, more preferably from 0.25% to 7.5% and most preferably from 0.5% to 5% by weight of the tablet.

Heavy metal ion sequestrants, which are acidic in nature, having for example phosphonic acid or carboxylic acid functionalities, may be present either in their acid form or as a complex/salt with a suitable counter cation such as an alkali or alkaline metal ion, ammonium, or substituted ammonium ion, or any mixtures thereof. Preferably any salts/complexes are water soluble. The molar ratio of said counter cation to the heavy metal ion sequestrant is preferably at least 1:1.

Suitable heavy metal ion sequestrants for use herein include organic phosphonates, such as the amino alkylene poly (alkylene phosphonates), alkali metal ethane 1-hydroxy disphosphonates and nitrilo trimethylene phosphonates.

Preferred among the above species are diethylene triamine penta (methylene phosphonate), ethylene diamine tri (methylene phosphonate) hexamethylene diamine tetra (methylene phosphonate) and hydroxy-ethylene 1,1 diphosphonate.

Other suitable heavy metal ion sequestrant for use herein include nitrilotriacetic acid and polyaminocarboxylic acids such as ethylenediaminotetracetic acid, ethylenetriamine pentacetic acid, ethylenediamine disuccinic acid, ethylenediamine diglutaric acid, 2-hydroxypropylenediamine disuccinic acid or any salts thereof.

Especially preferred is ethylenediamine-N,N'-disuccinic acid (EDDS) or the alkali metal, alkaline earth metal, ammonium, or substituted ammonium salts thereof, or mixtures thereof. Preferred EDDS compounds are the free acid form and the sodium or magnesium salt or complex thereof. Examples of such preferred sodium salts of EDDS include $Na_2$EDDS and $Na_3$EDDS. Examples of such preferred magnesium complexes of EDDS include MgEDDS and $Mg_2$EDDS.

Other suitable heavy metal ion sequestrants for use herein are iminodiacetic acid derivatives such as 2-hydroxyethyl diacetic acid or glyceryl imino diacetic acid, described in EP-A-317,542 and EP-A-399,133.

The iminodiacetic acid-N-2-hydroxypropyl sulfonic acid and aspartic acid N-carboxymethyl N-2-hydroxypropyl-3-sulfonic acid sequestrants described in EPA-516,102 are also suitable herein. The β-alanine-N,N'-diacetic acid, aspartic acid-N,N'-diacetic acid, aspartic acid-N-monoacetic acid and iminodisuccinic acid sequestrants described in EP-A-509,382 are also suitable.

EP-A-476,257 describes suitable amino based sequestrants. EP-A-510,331 describes suitable sequestrants derived from collagen, keratin or casein. EP-A-528,859 describes a suitable alkyl iminodiacetic acid sequestrant. Dipicolinic acid and 2-phosphonobutane-1,2,4-tricarboxylic acid are alos suitable. Glycinamide-N,N'-disuccinic acid (GADS), ethylenediamine-N,N'-diglutaric acid (EDDG) and 2-hydroxypropylenediamine-N,N'-disuccinic acid (HPDDS) are also suitable.

Most preferred heavy metal ions for use herein is alkali metal ethane 1-hydroxy diphosphonates, in particular when used in combination with diethylene triamine penta (methylene phosphonate).

Perfume

The tablets of the present invention may also optionally comprise a perfume composition, that being either present in the coating if present or in the detergent composition, or even in both the coating and the detergent composition. Suitable perfumes herein include materials which provide an olfactory aesthetic benefit such as to make such tablets more aesthetically pleasing to the consumer, imparting a pleasant fragrance to fabrics treated therewith and/or cover any "chemical" odor that the product may have.

As used herein, perfume includes fragrant substance or mixture of substances including natural (i.e., obtained by extraction of flowers, herbs, leaves, roots, barks, wood, blossoms or plants), artificial (i.e., a mixture of different nature oils or oil constituents) and synthetic (i.e., synthetically produced) odoriferous substances. Such materials are often accompanied by auxiliary materials, such as fixatives, extenders, stabilizers and solvents. These auxiliaries are also included within the meaning of "perfume", as used herein. Typically, perfumes are complex mixtures of a plurality of organic compounds.

Suitable perfumes are disclosed in U.S. Pat. No. 5,500,138, said patent being incorporated herein by reference.

Examples of perfume ingredients useful in the perfume compositions include, but are not limited to, hexyl cinnamic aldehyde; amyl cinnamic aldehyde; amyl salicylate; hexyl salicylate; terpineol; 3,7-dimethyl-cis-2,6-octadien-1-ol; 2,6-dimethyl-2-octanol; 2,6-dimethyl-7-octen-2-ol; 3,7-dimethyl-3-octanol; 3,7-dimethyl-trans-2,6-octadien-1-ol; 3,7-dimethyl-6-octen-1-ol; 3,7-dimethyl-1-octanol; 2-methyl-3-(para-tert-butylphenyl)-propionaldehyde; 4-(4-hydroxy-4-methylpentyl)-3-cyclohexene-1-carboxaldehyde; tricyclodecenyl propionate; tricyclodecenyl acetate; anisaldehyde; 2-methyl-2-(para-iso-propylphenyl)-propionaldehyde; ethyl-3-methyl-3-phenyl glycidate; 4-(para-hydroxyphenyl)-butan-2-one; 1-(2,6,6-trimethyl-2-cyclohexen-1-yl)-2-buten-1-one; para-methoxyacetophenone; para-methoxy-alpha-phenylpropene; methyl-2-n-hexyl-3-oxo-cyclopentane carboxylate; undecalactone gamma.

Additional examples of fragrance materials include, but are not limited to, orange oil; lemon oil; grapefruit oil; bergamot oil; clove oil; dodecalactone gamma; methyl-2-(2-pentyl-3-oxo-cyclopentyl) acetate; beta-naphthol methyl-ether; methyl-beta-naphthylketone; coumarin; decylaldehyde; benzaldehyde; 4-tert-butylcyclohexyl acetate; alpha, alpha-dimethylphenethyl acetate; methylphenylcarbinyl acetate; cyclic ethyleneglycol diester of tridecandioic acid; 3,7-dimethyl-2,6-octadiene-1-nitrile; ionone gamma methyl; ionone alpha; ionone beta; petitgrain; methyl cedrylone; 7-acetyl-1,2,3,4,5,6,7,8-octahydro-1,1,6,7-tetramethyl-naphthalene; ionone methyl; methyl-1,6,10-trimethyl-2,5,9-cyclododecatrien-1-yl ketone; 7-acetyl-1,1,3,4,4,6-hexamethyl tetralin; 4-acetyl-6-tert-butyl-1,1-dimethyl indane; benzophenone; 6-acetyl-1,1,2,3,3,5-hexamethyl indane; 5-acetyl-3-isopropyl-1,1,2,6-tetramethyl indane; 1-dodecanal; 7-hydroxy-3,7-dimethyl octanal; 10-undecen-1-al; iso-hexenyl cyclohexyl carboxaldehyde; formyl tricyclodecan; cyclopentadecanolide; 16-hydroxy-9-hexadecenoic acid lactone; 1,3,4,6,7,8-hexahydro-4,6,6,7,8,8-hexamethylcyclopenta-gamma-2-benzopyrane; ambroxane; dodecahydro-3a,6,6,9a-tetramethylnaphtho-[2,1b]furan; cedrol; 5-(2,2,3-trimethylcyclopent-3-enyl)-3-methylpentan-2-ol; 2-ethyl-4-(2,2,3-trimethyl-3-cyclopenten-1-yl)-2-buten-1-ol; caryophyllene alcohol; cedryl acetate; para-tert-butylcyclohexyl acetate; patchouli; olibanum resinoid; labdanum; vetivert; copaiba balsam; fir balsam; hydroxycitronellal and indol; phenyl acetaldehyde and indol;

More examples of perfume components are geraniol; geranyl acetate; linalool; linalyl acetate; tetrahydrolinalool; citronellol; citronellyl acetate; dihydromyrcenol; dihydromyrcenyl acetate; tetrahydromyrcenol; terpinyl acetate; nopol; nopyl acetate; 2-phenylethanol; 2-phenylethyl acetate; benzyl alcohol; benzyl acetate; benzyl salicylate; benzyl benzoate; styrallyl acetate; dimethylbenzylcarbinol; trichloromethylphenylcarbinyl methylphenylcarbinyl acetate; isononyl acetate; vetiveryl acetate; vetiverol; 2-methyl-3-(p-tert-butylphenyl)-propanal; 2-methyl-3-(p-isopropylphenyl)-propanal; 3-(p-tert-butylphenyl)-propanal; 4-(4-methyl-3-pentenyl)-3-cyclohexenecarbaldehyde; 4-acetoxy-3-pentyltetrahydropyran; methyl dihydrojasmonate; 2-n-heptylcyclopentanone; 3-methyl-2-pentyl-cyclopentanone; n-decanal; n-dodecanal; 9-decenol-1; phenoxyethyl isobutyrate; phenylacetaldehyde dimethylacetal; phenylacetaldehyde diethylacetal; geranonitrile; citronellonitrile; cedryl acetal; 3-isocamphylcyclohexanol; cedryl methylether; isolongifolanone; aubepine nitrile; aubepine; heliotropine; eugenol; vanillin; diphenyl oxide; hydroxycitronellal ionones; methyl ionones; isomethyl ionomes; irones; cis-3-hexenol and esters thereof; indane musk fragrances; tetralin musk fragrances; isochroman musk fragrances; macrocyclic ketones; macrolactone musk fragrances; ethylene brassylate.

The perfumes useful in the present invention compositions are substantially free of halogenated materials and nitromusks.

Preferably, the perfume composition contains less than 0.6% by weight of the perfume composition of Schiff-base. The perfume for use herein is used at levels of up to 5 grams per tablet and preferably is substantially free of Schiff-Base.

By "substantially free", it is meant that the perfume composition comprises less than 0.4% by weight of Schiff Base, and more preferably is free of Schiff base.

Schiff-Bases are the condensation of an aldehyde perfume ingredient with an anthranilate. A typical description can be found in U.S. Pat. No. 4,853,369. The Schiff Bases can be added directly to the perfume composition or can be formed in situ in the perfume composition by adding to it an Anthranilate such as Methyl or Ethyl Anthranilate along with an aldehyde which can react with the Anthranilate to form the Schiff Base.

Not to be bound by theory, it is believed that when this compound comes in contact with the clay it can undergo reactions most likely catalysed by the metal ions present in the clay and that these reactions produce more highly coloured by-products.

Typical of Schiff bases are selected from Schiff's base of 4-(4-hydroxy-4-methylpentyl)-3-cyclohexene-1-carboxaldehyde and methyl anthranilate; condensation products of: hydroxycitronellal and methyl anthranilate; 4-(4-hydroxy-4-methyl pentyl)-3-cyclohexene-1-carboxaldehyde and methyl anthranilate; Methyl Anthranilate and Hydroxy-Citronellal commercially available under the tradename Aurantiol; Methyl Anthranilate and Methyl Nonyl Acetaldehyde commercially available under the tradename Agrumea; Methyl Anthranilate and PT Bucinal commercially available under the tradename Verdantiol; Methyl anthranilate and Lyral commercially available under the tradename Lyrame; Methyl Anthranilate and Ligustral commercially available under the tradename Ligantral; and mixtures thereof.

Preferably, the perfume composition is free of perfume ingredients selected from Methyl Anthranilate and Hydroxy-Citronellal commercially available under the tradename Aurantiol; Methyl Anthranilate and Methyl Nonyl Acetaldehyde commercially available under the tradename Agrumea; Methyl Anthranilate and PT Bucinal commercially available under the tradename Verdantiol; Methyl anthranilate and Lyral commercially available under the tradename Lyrame; Methyl Anthranilate and Ligustral commercially available under the tradename Ligantral; and mixtures thereof.

Suitable solvents, diluents or carriers for perfumes ingredients mentioned above are for examples, ethanol, isopropanol, diethylene glycol, monoethyl ether, dipropylene glycol, diethyl phthalate, triethyl citrate, etc. The amount of such solvents, diluents or carriers incorporated in the perfumes is preferably kept to the minimum needed to provide a homogeneous perfume solution.

Tablets of the present invention as well as coated tablets according to the invention provide improved fabric perfume deposition.

Preferably, the perfume composition is present in an amount of 0.001% to 10%, preferably from 0.005% to 5%, more preferably from 0.01% to 3%, and even more preferably from 0.02% to 2% by weight of the tablet.

The perfume can be incorporated to the tablet by any conventional means known to the skilled person. One preferred means is by spray-on of the perfume composition onto the tablet.

Detergent Ingredients

The tablets may comprise components such as surfactants, enzymes, detergent etc. . . . Typical tablet compositions for the preferred embodiment of the present invention are disclosed in the pending European applications of the Applicant no. 96203471.6, publication date Jun. 10, 1998, 96203462.5, publication date Jun. 10, 1998, 96203473.2, publication date Jun. 10, 1998, and 96203464.1, publication date Jun. 10, 1998, for example. Elements typically entering in the composition of detergent tablets or of other forms of detergents such as liquids or granules are detailed in the following paragraphs.

Detersive Surfactants

Surfactant are typically comprised in a detergent composition. The dissolution of surfactants is favoured by the addition of the highly soluble compound. Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3{-}M^+)\ CH_3$ and $CH_3\ (CH_2)_y(CHOSO_3{-}M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10\text{-}18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are listed in standard texts. In a preferred embodiment, the tablet comprises at least 5% per weight of surfactant, more preferably at least 15% per weight, even more preferably at least 25% per weight, and most preferably between 35% and 45% per weight of surfactant.

Non Gelling Binders

Non gelling binders can be integrated in detergent compositions to further facilitate dissolution.

If non gelling binders are used, suitable non-gelling binders include synthetic organic polymers such as polyethylene glycols, polyvinylpyrrolidones, polyacrylates and water-soluble acrylate copolymers. The handbook of Pharmaceutical Excipients second edition, has the following binders classification: *Acacia*, Alginic Acid, Carbomer, Carboxymethylcellulose sodium, Dextrin, Ethylcellulose, Gelatin, Guar gum, Hydrogenated vegetable oil type I, Hydroxyethyl cellulose, Hydroxypropyl methylcellulose, Liquid glucose, Magnesium aluminum silicate, Maltodextrin, Methylcellulose, polymethacrylates, povidone, sodium alginate, starch and zein. Most preferable binders also have an active cleaning function in the laundry wash such as cationic polymers, i.e. ethoxylated hexamethylene diamine quaternary compounds, bishexamethylene triamines, or others such as pentaamines, ethoxylated polyethylene amines, maleic acrylic polymers.

Non-gelling binder materials are preferably sprayed on and hence have an appropriate melting point temperature below 90° C., preferably below 70° C. and even more preferably below 50° C. so as not to damage or degrade the other active ingredients in the matrix. Most preferred are non-aqueous liquid binders (i.e. not in aqueous solution) which may be sprayed in molten form. However, they may also be solid binders incorporated into the matrix by dry addition but which have binding properties within the tablet.

Non-gelling binder materials are preferably used in an amount within the range from 0.1 to 15% of the composition, more preferably below 5% and especially if it is a non laundry active material below 2% by weight of the tablet.

It is preferred that gelling binders, such as nonionic surfactants are avoided in their liquid or molten form. Nonionic surfactants and other gelling binders are not excluded from the compositions, but it is preferred that they be processed into the detergent tablets as components of particulate materials, and not as liquids.

Builders

Detergent builders can optionally be included in the compositions herein to assist in controlling mineral hardness. Inorganic as well as organic builders can be used. Builders are typically used in fabric laundering compositions to assist in the removal of particulate soils.

The level of builder can vary widely depending upon the end use of the composition.

Inorganic or P-containing detergent builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6 is the trademark for a crystalline layered silicate marketed by Hoechst (commonly abbreviated herein as "SKS-6"). Unlike zeolite builders, the Na SKS-6 silicate builder does not contain aluminum. NaSKS-6 has the delta-$Na_2SiO_5$ morphology form of layered silicate. It can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the alpha, beta and gamma forms. As noted above, the delta-$Na_2SiO_5$ (NaSKS-6 form) is most preferred for use herein. Other silicates may also be useful such as for example magnesium silicate, which can serve as a crispening agent in granular formulations, as a stabilizing agent for oxygen bleaches, and as a component of suds control systems.

Examples of carbonate builders are the alkaline earth and alkali metal carbonates as disclosed in German Patent Application No. 2,321,001 published on Nov. 15, 1973.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(ZAlO_2)_y].xH_2O$$

wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula:

$$Na_{12}[(AlO_2)_{12}(SiO_2)_{12}].xH_2O$$

wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred. Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

Citrate builders, e.g., citric acid and soluble salts thereof (particularly sodium salt), are polycarboxylate builders of particular importance for heavy duty liquid detergent formulations due to their availability from renewable resources and their biodegradability. Citrates can also be used in granular compositions, especially in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof. A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also Diehl U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used.

Bleach

The detergent compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches as well as other bleaching agents. Perborate bleaches, e.g., sodium perborate (e.g., mono- or tetra-hydrate) can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al. Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915, 854, issued Apr. 10, 1990 to Mao et al, and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L \text{ or } R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl)oxybenzenesulfonate, (6-nonanamidocaproyl)oxybenzenesulfonate, (6-decanamido-caproyl)oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

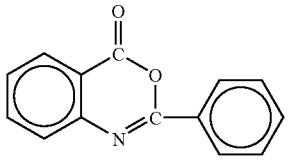

Still another class of preferred bleach activators includes the acyl lactam activators, especially acyl caprolactams and acyl valerolactams of the formulae:

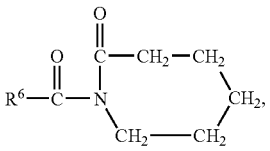

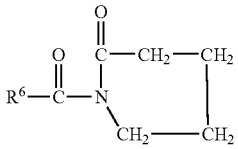

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985, incorporated herein by reference, which discloses acyl caprolactams, including benzoyl caprolactam, adsorbed into sodium perborate.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonate zinc phthalocyanine.

If desired, the bleaching compounds can be catalyzed by means of a manganese compound. Such compounds are well known in the art and include, for example, the manganese-based catalysts disclosed in U.S. Pat. No. 5,246,621, U.S. Pat. No. 5,244,594; U.S. Pat. No. 5,194,416; U.S. Pat. No. 5,114,606; and European Pat. App. Pub. Nos. 549,271A1, 549,272A1, 544,440A2, and 544,490A1; Preferred examples of these catalysts include $Mn^{IV}_2(u\text{-}O)_3$(1,4,7-trimethyl-1,4,7-triazacyclononane)$_2(PF_6)_2$, $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4(ClO_4)_4$, $Mn^{III}Mn^{IV}_4(u\text{-}O)_1(u\text{-}OAc)_2$-(1,4,7-trimethyl-1,4,7-triazacyclononane)$_2(ClO_4)_3$, $Mn^{IV}$(1,4,7-trimethyl-1,4,7-triazacyclononane)-$(OCH_3)_3(PF_6)$, and mixtures thereof. Other metal-based bleach catalysts include those disclosed in U.S. Pat. No. 4,430,243 and U.S. Pat. No. 5,114,611. The use of manganese with various complex ligands to enhance bleaching is also reported in the following U.S. Pat. Nos.: 4,728,455; 5,284,944; 5,246,612; 5,256,779; 5,280,117; 5,274,147; 5,153,161; and 5,227,084.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Enzymes

Enzymes can be included in the formulations herein for a wide variety of fabric laundering purposes, including removal of protein-based, carbohydrate-based, or triglyceride-based stains, for example, and for the prevention of refugee dye transfer, and for fabric restoration. The enzymes to be incorporated include proteases, amylases, lipases, cellulases, and peroxidases, as well as mixtures thereof. Other types of enzymes may also be included. They may be of any suitable origin, such as vegetable, animal, bacterial, fungal and yeast origin.

However, their choice is governed by several factors such as pH-activity and/or stability optima, thermostability, stability versus active detergents, builders and so on. In this respect bacterial or fungal enzymes are preferred, such as bacterial amylases and proteases, and fungal cellulases.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1% by weight of a commercial enzyme preparation. Protease enzymes are usually present in such commercial preparations at levels sufficient to provide from 0.005 to 0.1 Anson units (AU) of activity per gram of composition.

Suitable examples of proteases are the subtilisins which are obtained from particular stains of *B. subtilis* and *B. licheniforms*. Another suitable protease is obtained from a strain of *Bacillus*, having maximum activity throughout the pH range of 8–12, developed and sold by Novo Industries A/S under the registered trade name ESPERASE. The preparation of this enzyme and analogous enzymes is described in British Patent Specification No. 1,243,784 of Novo. Proteolytic enzymes suitable for removing protein-based stains that are commercially available include those sold under the tradenames ALCALASE and SAVINASE by Novo Industries A/S (Denmark) and MAXATASE by International Bio-Synthetics, Inc. (The Netherlands). Other proteases include Protease A (see European Patent Application 130,756, published Jan. 9, 1985) and Protease B (see European Patent Application 130,756, Bott et al, published Jan. 9, 1985).

Amylases include, for example, α-amylases described in British Patent Specification No. 1,296,839 (Novo), RAPIDASE, International Bio-Synthetics, Inc. and TERMAMYL, Novo Industries.

The cellulase usable in the present invention include both bacterial or fungal cellulase. Preferably, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and *Humicola* strain DSM1800 or a cellulase 212-producing fungus belonging to the genus *Aeromonas*, and cellulase extracted from the hepatopancreas of a marine mollusk (Dolabella Auricula Solander). suitable cellulases are also disclosed in GB-A-2.075.028; GB-A-2.095.275 and DE-OS-2.247.832. CAREZYME (Novo) is especially useful.

Suitable lipase enzymes for detergent usage include those produced by microorganisms of the *Pseudomonas* group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex Chromobacter viscosum, e.g. Chromobacter viscosum var. *lipolyticum* NRRLB 3673, commercially available from Toyo Jozo Co., Tagata, Japan; and further Chromobacter viscosum lipases from U.S. Biochemical Corp., U.S.A. and Disoynth Co., The Netherlands, and lipases ex *Pseudomonas gladioli*. The LIPOLASE enzyme derived from *Humicola lanuginosa* and commercially available from Novo (see also EPO 341,947) is a preferred lipase for use herein. Peroxidase enzymes are used in combination with oxygen sources, e.g., percarbonate, perborate, persulfate, hydrogen peroxide, etc. They are used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985, both. Enzyme materials useful for liquid detergent formulations, and their incorporation into such formulations, are disclosed in U.S. Pat. No. 4,261,868, Hora et al, issued Apr. 14, 1981. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Flocculating Agent

The detergent composition may contain a clay flocculating agent, preferably present at a level of from 0.005% to 10%, more preferably from 0.05% to 5%, most preferably from 0.1% to 2% by weight of the composition.

The clay flocculating agent functions such as to bring together the particles of clay compound in the wash solution and hence to aid their deposition onto the surface of the fabrics in the wash. This functional requirement is hence different from that of clay dispersant compounds which are commonly added to laundry detergent compositions to aid the removal of clay soils from fabrics and enable their dispersion within the wash solution.

Preferred as clay flocculating agents herein are organic polymeric materials having an average weight of from 100,000 to 10,000,000, preferably from 150,000 to 5,000,000, more preferably from 200,000 to 2,000,000.

Suitable organic polymeric materials comprise homopolymers or copolymers containing monomeric units selected from alkylene oxide, particularly ethylene oxide, acrylamide, acrylic acid, vinyl alcohol, vinyl pyrrolidone, and ethylene imine. Homopolymers of, on particular, ethylene oxide, but also acrylamide and acrylic acid are preferred.

European Patents No.s EP-A-299,575 and EP-A-313,146 in the name of the Procter and Gamble Company describe preferred organic polymeric clay flocculating agents for use herein.

Inorganic clay flocculating agents are also suitable herein, typical examples of which include lime and alum.

The flocculating agent is preferably present in a detergent base granule such as a detergent agglomerate, extrudate or spray-dried particle, comprising generally one or more surfactants and builders.

It may be preferred that the flocculating agent is also comprised in the particle or granule comprising the clay.

When present, the weight ratio of clay to the flocculating polymer is preferably from 1000:1 to 1:1, more preferably from 500:1 to 1:1, most preferably from 300:1 to 1:1, or even more preferably from 80:1 to 10:1, or in certain applications even from 60:1 to 20:1.

Other components which are commonly used in detergent compositions and which may be incorporated into detergent tablets include chelating agents, soil release agents, soil antiredeposition agents, dispersing agents, suds suppressors, fabric softeners, dye transfer inhibition agents and mixtures thereof.

Highly Soluble Compounds

The tablet may comprise a highly soluble compound. Such a compound could be formed from a mixture or from a single compound. A highly soluble compound is defined as follow:

A solution is prepared as follows comprising de-ionised water as well as 20 grams per liter of a specific compound:

1—20 g of the specific compound is placed in a Sotax Beaker. This beaker is placed in a constant temperature bath set at 10° C. A stirrer with a marine propeller is placed in the beaker so that the bottom of the stirrer is at 5 mm above the bottom of the Sotax beaker. The mixer is set at a rotation speed of 200 turns per minute.

2—980 g of the de-ionised water is introduced into the Sotax beaker.

3—10 s after the water introduction, the conductivity of the solution is measured, using a conductivity meter.

4—Step 3 is repeated after 20, 30, 40, 50, 1 min, 2 min, 5 min and 10 min after step 2.

5—The measurement taken at 10 min is used as the plateau value or maximum value.

The specific compound is highly soluble according to the invention when the conductivity of the solution reaches 80% of its maximum value in less than 10 seconds, starting from the complete addition of the de-ionised water to the compound. Indeed, when monitoring the conductivity in such a manner, the conductivity reaches a plateau after a certain period of time, this plateau being considered as the maximum value. Such a compound is preferably in the form of a flowable material constituted of solid particles at temperatures comprised between 10 and 80° Celsius for ease of handling, but other forms may be used such as a paste or a liquid.

Example of highly soluble compounds include Sodium di isoalkylbenzene sulphonate (DIBS) or Sodium toluene sulphonate.

Cohesive Effect

The tablet may comprise a compound having a Cohesive Effect on the particulate material of a detergent matrix forming the tablet. The Cohesive Effect on the particulate material of a detergent matrix forming the tablet or a layer of the tablet is characterised by the force required to break a tablet or layer based on the examined detergent matrix pressed under controlled compression conditions. For a given compression force, a high tablet or layer strength indicates that the granules stuck highly together when they were compressed, so that a strong cohesive effect is taking place. Means to assess tablet or layer strength (also refer to diametrical fracture stress) are given in Pharmaceutical dosage forms: tablets volume 1 Ed. H. A. Lieberman et al, published in 1989.

The cohesive effect is measured by comparing the tablet or layer strength of the original base powder without compound having a cohesive effect with the tablet or layer strength of a powder mix which comprises 97 parts of the original base powder and 3 parts of the compound having a cohesive effect. The compound having a cohesive effect is preferably added to the matrix in a form in which it is substantially free of water (water content below 10% (pref. below 5%)). The temperature of the addition is between 10 and 80 C, more pref. between 10 and 40 C.

A compound is defined as having a cohesive effect on the particulate material according to the invention when at a given compacting force of 3000N, tablets with a weight of 50 g of detergent particulate material and a diameter of 55 mm have their tablet tensile strength increased by over 30% (preferably 60 and more preferably 100%) by means of the presence of 3% of the compound having a cohesive effect in the base particulate material.

An example of a compound having a cohesive effect is Sodium di isoalkylbenzene sulphonate.

When integrating a highly soluble compound having also a cohesive effect on the particulate material used for a tablet or layer formed by compressing a particulate material comprising a surfactant, the dissolution of the tablet or layer in an aqueous solution is significantly increased.

In a preferred embodiment, at least 1% per weight of a tablet or layer is formed from the highly soluble compound, more preferably at least 2%, even more preferably at lest 3% and most preferably at least 5% per weight of the tablet or layer being formed from the highly soluble compound having a cohesive effect on the particulate material.

It should be noted that a composition comprising a highly soluble compound as well as a surfactant is disclosed in EP-A-0 524 075, this composition being a liquid composition.

A highly soluble compound having a cohesive effect on the particulate material allows to obtain a tablet having a higher tensile strength at constant compacting force or an equal tensile strength at lower compacting force when compared to traditional tablets. Typically, a whole tablet will have a tensile strength of more than 5 kPa, preferably of more than 10 kPa, more preferably, in particular for use in laundry applications, of more than 15 kPa, even more preferably of more than kPa and most preferably of more than 50 kPa, in particular for use in dish washing or auto dish washing applications; and a tensile strength of less than 300 kPa, preferably of less than 200 kPa, more preferably of less than. 100 kPa, even more preferably of less than 80 kPa and most preferably of less than 60 kPa. Indeed, in case of laundry application, the tablets should be less compressed than in case of auto dish washing applications for example, whereby the dissolution is more readily achieved, so that in a laundry application, the tensile strength is preferably of less than 30 kPa.

This allows to produce tablets or layers which have a solidity and mechanical resistance comparable to the solidity or mechanical resistance of traditional tablets while having a less compact tablet or layer thus dissolving more readily. Furthermore, as the compound is highly soluble, the dissolution of the tablet or layer is further facilitated, resulting in a synergy leading to facilitated dissolution for a tablet according to the invention.

Tablet Manufacture

The tablet may comprise several layers. For the purpose of manufacture of a single layer, the layer may be considered as a tablet itself.

Detergent tablets can be prepared simply by mixing the solid ingredients together and compressing the mixture in a conventional tablet press as used, for example, in the pharmaceutical industry. Preferably the principal ingredients, in particular gelling surfactants, are used in particulate form. Any liquid ingredients, for example surfactant or suds suppressor, can be incorporated in a conventional manner into the solid particulate ingredients.

In particular for laundry tablets, the ingredients such as builder and surfactant can be spray-dried in a conventional manner and then compacted at a suitable pressure. Preferably, the tablets according to the invention are compressed using a force of less than 100000N, more preferably of less than 50000N, even more preferably of less than 5000N and most preferably of less than 3000 N. Indeed, the most preferred embodiment is a tablet suitable for laundry compressed using a force of less than 2500N, but tablets for auto dish washing may also be considered for example, whereby such auto dish washing tablets are usually more compressed than laundry tablets.

The particulate material used for making a tablet can be made by any particulation or granulation process. An example of such a process is spray drying (in a co-current or counter current spray drying tower) which typically gives low bulk densities 600 g/l or lower. Particulate materials of higher density can be prepared by granulation and densification in a high shear batch mixer/granulator or by a continuous granulation and densification process (e.g. using Lodige® CB and/or Lodige® KM mixers). Other suitable processes include fluid bed processes, compaction processes (e.g. roll compaction), extrusion, as well as any particulate material made by any chemical process like flocculation, crystallisation sentering, etc. Individual particles can also be any other particle, granule, sphere or grain.

The components of the particulate material may be mixed together by any conventional means. Batch is suitable in, for example, a concrete mixer, Nauta mixer, ribbon mixer or any other. Alternatively the mixing process may be carried out continuously by metering each component by weight on to a moving belt, and blending them in one or more drum(s) or mixer(s). Non-gelling binder can be sprayed on to the mix of some, or all of, the components of the particulate material. Other liquid ingredients may also be sprayed on to the mix of components either separately or premixed. For example perfume and slurries of optical brighteners may be sprayed. A finely divided flow aid (dusting agent such as zeolites, carbonates, silicas) can be added to the particulate material after spraying the binder, preferably towards the end of the process, to make the mix less sticky.

The tablets may be manufactured by using any compacting process, such as tabletting, briquetting, or extrusion, preferably tabletting. Suitable equipment includes a standard single stroke or a rotary press (such as Courtoy®, Korch®, Manesty®, or Bonals®). The tablets prepared according to this invention preferably have a diameter of between 20 mm and 60 mm, preferably of at least and up to 55 mm, and a weight between 25 and 100 g. The ratio of height to diameter (or width) of the tablets is preferably greater than 1:3, more preferably greater than 1:2. The compaction pressure used for preparing these tablets need not exceed 100000 $kN/m^2$, preferably not exceed 30000 $kN/m^2$, more preferably not exceed 5000 $kN/m^2$, even more preferably not exceed 3000$kN/m^2$ and most preferably not exceed 1000$kN/m^2$. In a preferred embodiment according to the invention, the tablet has a density of at least 0.9 g/cc, more preferably of at least 1.0 g/cc, and preferably of less than 2.0 g/cc, more preferably of less than 1.5 g/cc, even more preferably of less than 1.25 g/cc and most preferably of less than 1.1 g/cc.

Multi layered tablets are typically formed in rotating presses by placing the matrices of each layer, one after the other in matrix force feeding flasks. As the process continues, the matrix layers are then pressed together in the precompression and compression stages stations to form the multilayer layer tablet. With some rotating presses it is also possible to compress the first feed layer before compressing the whole tablet.

Hydrotrope Compound

A highly soluble compound having a cohesive effect may be integrated to a detergent tablet, whereby this compound is also a hydrotrope compound. Such hydrotrope compound may be generally used to favour surfactant dissolution by avoiding gelling. A specific compound is defined as being hydrotrope as follows (see S. E. Friberg and M. Chiu, J. Dispersion Science and Technology, 9(5&6), pages 443 to 457, (1988–1989)):

1. A solution is prepared comprising 25% by weight of the specific compound and 75% by weight of water.

2. Octanoic Acid is thereafter added to the solution in a proportion of 1.6 times the weight of the specific compound in solution, the solution being at a temperature of 20° Celsius. The solution is mixed in a Sotax beaker with a stirrer with a marine propeller, the propeller being situated at about 5 mm above the bottom of the beaker, the mixer being set at a rotation speed of 200 rounds per minute.

3. The specific compound is hydrotrope if the the Octanoic Acid is completely solubilised, i.e. if the solution comprises only one phase, the phase being a liquid phase.

It should be noted that in a preferred embodiment of the invention, the hydrotrope compound is a flowable material made of solid particles at operating conditions between 15 and 60° Celsius.

Hydrotrope compounds include the compounds listed thereafter:

A list of commercial hydrotropes can be found in McCutcheon's Emulsifiers and Detergents published by the McCutcheon division of Manufacturing Confectioners Company.

Compounds of interest also include:

1. Nonionic hydrotrope with the following structure:

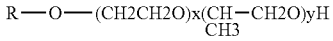

where R is a C8–C10 alkyl chain, x ranges from 1 to 15, y from 3 to 10.

2. Anionic hydrotropes such as alkali metal aryl sulfonates. This includes alkali metal salts of benzoic acid, salicylic acid, bezenesulfonic acid and its many derivatives, naphthoic acid and various hydroaromatic acids. Examples of these are sodium, potassium and ammonium benzene sulfonate salts derived from toluene sulfonic acid, xylene sulfonic acid, cumene sulfonic acid, tetralin sulfonic acid, naphtalene sulfonic acid, methyl-naphtalene sulfonic acid, dimethyl naphtalene sulfonic acid, trimethyl naphtalene sulfonic acid=Other examples include salts of dialkyl benzene sulfonic acid such as salts of diisopropyl benzene sulfonic acid, ethyl methyl benzene sulfonic acid, alkyl benzene sulfonic acid with an alkyl chain length with 3 to 10, (pref. 4 to 9), linear or branched alkyl sulfonates with an alkyl chain with 1 to 18 carbons.

3. Solvent hydrotropes such as alkoxylated glycerines and alkoxylated glycerides, esters slakoxylated glycerines, alkoxylated fatty acids, esters of glycerin, polyglycerol esters. Preferred alkoxylated glycerines have the following structure:

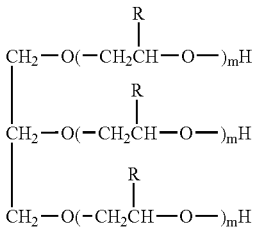

where l, m and n are each a number from 0 to about 20, with l+m+n=from about 2 to about 60, preferably from about 10 to about 45 and R represents H, $CH_3$ or $C_2H_5$ Preferred alkoxylated glycerides have the following struture

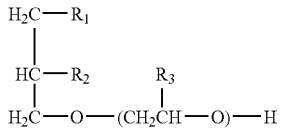

where R1 and R2 are each $C_nCOO$ or $-(CH2CHR_3—O)_l—H$ where $R_3$=H, $CH_3$ or $C_2H_5$ and l is a number from 1 to about 60, n is a number from about 6 to about 24.

4. Polymeric hydrotropes such as those described in EP636687:

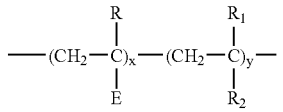

where E is a hydrophilic functional group,

R is H or a C1–C10 alkyl group or is a hydrophilic functional group;

R1 is H a lower alkyl group or an aromatic group,

R2 is H or a cyclic alkyl or aromatic group.

The polymer typically has a molecular weight of between about 1000 and 1000000.

5. Hydrotrope of unusual structure such as 5-carboxy-4-hexyl-2-cyclohexene-1-yl octanoic acid (Diacid®).

Use of such compound in the invention would further increase the dissolution rate of the tablet, as a hydrotrope compound facilitates dissolution of surfactants, for example. Such a compound could be formed from a mixture or from a single compound.

Tensile Strength

For the purpose of measuring tensile strength of a layer, the layer may be considered as a tablet itself.

Depending on the composition of the starting material, and the shape of the tablets, the used compacting force may be adjusted to not affect the tensile strength, and the disintegration time in the washing machine. This process may be used to prepare homogenous or layered tablets of any size or shape.

For a cylindrical tablet, the tensile strength corresponds to the diametrical fracture stress (DFS) which is a way to express the strength of a tablet or layer, and is determined by the following equation $$\text{Tensile strength}=2F/\pi Dt$$

Where F is the maximum force (Newton) to cause tensile failure (fracture) measured by a VK 200 tablet hardness tester supplied by Van Kell industries, Inc. D is the diameter of the tablet or layer, and t the thickness of the tablet or layer. For a non round tablet, πD may simply be replaced by the perimeter of the tablet.

(Method Pharmaceutical Dosage Forms: Tablets Volume 2 Page 213 to 217). A tablet having a diametral fracture stress of less than 20 kPa is considered to be fragile and is likely to result in some broken tablets being delivered to the consumer. A diametral fracture stress of at least 25 kPa is preferred.

This applies similarly to non cylindrical tablets, to define the tensile strength, whereby the cross section normal to the height of the tablet is non round, and whereby the force is applied along a direction perpendicular to the direction of the height of the tablet and normal to the side of the tablet, the side being perpendicular to the non round cross section.

Tablet Dispensing

The rate of dispensing of a detergent tablet can be determined in the following way:

Two tablets, nominally 50 grams each, are weighed, and then placed in the dispenser of a Baucknecht® WA9850 washing machine. The water supply to the washing machine is set to a temperature of 20° C. and a hardness of 21 grains per gallon, the dispenser water inlet flow-rate being set to 8 l/min. The level of tablet residues left in the dispenser is checked by switching the washing on and the wash cycle set to wash program 4 (white/colors, short cycle). The dispensing percentage residue is determined as follows:

$$\%\ \text{dispensing}=\text{residue weight}\times 100/\text{original tablet weight}$$

The level of residues is determined by repeating the procedure 10 times and an average residue level is calculated based on the ten individual measurements. In this stressed test a residue of 40% of the starting tablet weight is considered to be acceptable. A residue of less than 30% is preferred, and less than 25% is more preferred.

It should be noted that the measure of water hardness is given in the traditional "grain per gallon" unit, whereby 0.001 mole per liter=7.0 grain per gallon, representing the concentration of $Ca^{2+}$ ions in solution.

Effervescent

Detergent tablets may further comprise an effervescent.

Effervescency as defined herein means the evolution of bubbles of gas from a liquid, as the result of a chemical reaction between a soluble acid source and an alkali metal carbonate, to produce carbon dioxide gas, i.e. $C_6H_8O_7+3NaHCO_3 \rightarrow Na_3C_6H_5O_7+3CO_2\uparrow 3H_2O$ Further examples of acid and carbonate sources and other effervescent systems may be found in: (Pharmaceutical Dosage Forms: Tablets Volume 1 Page 287 to 291).

An effervescent may be added to the tablet mix in addition to the detergent ingredients. The addition of this effervescent to the detergent tablet improves the disintegration time of the tablet. The amount will preferably be between 5 and 20% and most preferably between 10 and 20% by weight of the tablet. Preferably the effervescent should be added as an agglomerate of the different particles or as a compact, and not as separated particles.

Due to the gas created by the effervescency in the tablet, the tablet can have a higher D.F.S. and still have the same disintegration time as a tablet without effervescency. When the D.F.S. of the tablet with effervescency is kept the same as a tablet without, the disintegration of the tablet with effervescency will be faster.

Further dissolution aid could be provided by using compounds such as sodium acetate or urea. A list of suitable dissolution aid may also be found in Pharmaceutical Dosage Forms: Tablets, Volume 1, Second edition, Edited by H. A. Lieberman et all, ISBN 0-8247-8044-2.

Coating

Solidity of a tablet may be improved by making a coated tablet, the coating covering a non-coated tablet, thereby further improving the mechanical characteristics of the tablet while maintaining or further improving dissolution.

This very advantageously applies to multi-layer tablets, whereby the mechanical characteristics of a more elastic layer can be transmitted via the coating to the rest of the tablet, thus combining the advantage of the coating with the advantage of the more elastic layer. Indeed, mechanical constraints will be transmitted through the coating, thus improving mechanical integrity of the tablet.

In one embodiment of the present invention, the tablets may then be coated so that the tablet does not absorb moisture, or absorbs moisture at only a very slow rate. The coating is also strong so that moderate mechanical shocks to which the tablets are subjected during handling, packing and shipping result in no more than very low levels of breakage or attrition. Finally the coating is preferably brittle so that the tablet breaks up quickly when subjected to stronger mechanical shock. Furthermore it is advantageous if the coating material is dissolved under alkaline conditions, or is readily emulsified by surfactants. This contributes to avoiding the problem of visible residue in the window of a front-loading washing machine during the wash cycle, and also avoids deposition of undissolved particles or lumps of coating material on the laundry load.

Water solubility is measured following the test protocol of ASTM E1148-87 entitled, "Standard Test Method for Measurements of Aqueous Solubility".

Fracture of the coating in the wash is improved by adding a disintegrant in the coating. This disintegrant will swell once in contact with water and break the coating in small pieces. This will improve the dissolution of the coating in the wash solution. Typically, the disintegrant is suspended in the coating melt at a level of up to 30%, preferably between 5% and 20%, most preferably between 5 and 10% by weight.

Clay mineral compound, as above described, is a disintegrant for use herein.

Other possible disintegrants which may be use in addition to the clay disintegrants are described in Handbook of Pharmaceutical Excipients (1986). Examples of suitable disintegrants include starch: natural, modified or pregelatinized starch, sodium starch gluconate; gum: agar gum, guar gum, locust bean gum, karaya gum, pectin gum, tragacanth gum; croscarmylose Sodium, crospovidone, cellulose, carboxymethyl cellulose, algenic acid and its salts including sodium alginate, silicone dioxide, clay, polyvinylpyrrolidone, soy polysacharides, ion exchange resins, polymers containing cationic (e.g. quaternary ammonium) groups, amine-substituted polyacrylates, polymerised cationic amino acids such as poly-L-lysine, polyallylamine hydrochloride) and mixtures thereof.

Preferably, the coating material has a melting point of at least 40° C., preferably of from 40° C. to 200° C.

By "melting point" is meant the temperature at which the material when heated slowly in, for example, a capillary tube becomes a clear liquid.

Preferably, the coating material which has a melting point of at least 40° C. is an acid. Acid having a melting temperature of at least 40° C. are for example dicarboxylic acids. Particularly suitable dicarboxylic acids are selected from the group consisting of oxalic acid, malonic acid, succinic acid, glutaric acid, adipic acid, pimelic acid, suberic acid, azelaic acid, sebacic acid, undecanedioic acid, dodecanedioic acid, tridecanedioic acid and mixtures thereof. Most preferred is adipic acid.

More preferably, the coating comprises a crystallised structure. By crystallised, it should be understood that the coating comprises a material which is solid at ambient temperature (25° C.) and has a structure exhibiting some order. This can be detected typically by usual crystallography techniques e.g. X-ray analysis, on the material itself. In a more preferred embodiment, the material forming the crystallised structure does not co-crystallised or only partially with the optional component which is liquid at 25° C. mentioned above. Indeed, it is preferred that the optional component remains in the liquid state at 25° C. in the coating crystalline structure in order to provide flexibility to the structure and resistance to mechanical stress. Most preferably, the above mentioned acid having a melting temperature of at least 40° C. comprises a crystallised structure.

Clearly substantially insoluble materials having a melting point below 40° C. are not sufficiently solid at ambient temperatures and it has been found that materials having a melting point above about 200° C. are not practicable to use. Preferably, an acid having a melting point of more than 90° C. such as azelaic, sebacic acid, dodecanedioic acid. However, for the purpose of the present invention, the use of sebacic acid is less preferred as it provides a detrimental odour to the resulting product. According to the invention, it was found that an acid having a melting point of more than 145° C. such as adipic was found particularly suitable.

The coating can be applied in a number of ways. Two preferred coating methods are a) coating with a molten material and b) coating with a solution of the material.

In a), the coating material is applied at a temperature above its melting point, and solidifies on the tablet. In b), the coating is applied as a solution, the solvent being dried to leave a coherent coating. The substantially insoluble material can be applied to the tablet by, for example, spraying or dipping. Normally when the molten material is sprayed on to the tablet, it will rapidly solidify to form a coherent coating. When tablets are dipped into the molten material and then removed, the rapid cooling again causes rapid solidification of the coating material. During the solidification phase, the coating undergoes some internal stress (e.g. shrinkage upon cooling) and external stress (e.g. tablet relaxation). This will likely cause some cracks in the structure such as edge splitting if the coating material is too brittle to withstand these mechanical stress, which is the case when a coating is solely made from components solid at 25° C. Thus, it is preferred that the coating comprises a component which is liquid at 25° C. Hence, it is believed that this liquid component will allow the coating to better withstand and absorb mechanical stress by rendering the coating structure more flexible. The component which is liquid at 25° C. is preferably added to the coating materials in proportions of less than 10% by weight of the coating, more preferably less than 5% by weight, and most preferably of less than 3% by weight. The component which is liquid at 25° C. is preferably added to the coating materials in proportions of more than 0.1% by weight of the coating, more preferably more than 0.3% by weight, and most preferably of more than 0.5% by weight.

Examples of optional components which are liquid at 25° C. includes polyethylene glycols, thermal oil, silicon oil, esters of dicarboxylic acids, mono carboxylic acids, parafin, triacetin, perfumes or alkaline solutions. For example, particularly good results were obtained by use of NaOH solution as alkaline solution.

It is preferred that the structure of the components which is liquid at 25° C. is close to the material forming the crystallised structure, so that the structure is not excessively disrupted.

In another embodiment, the optional component which is liquid at 25° C. may advantageously have a functionality in the washing of laundry, for example silicone oil which provides suds suppression benefits or perfume oil. When present, the perfume oil may be the perfume composition as per described herein, or a different perfume composition to that already contained by the tablet, provided it contains less than 0.6% by weight of Schiff-Base.

The coating may also comprise materials other than the optional component which is liquid at 25° C. Hence, further preferred, is the addition of reinforcing fibres to the coating in order to further reinforce the structure.

In a most preferred embodiment, the crystallised structure is made of adipic acid, the component which is liquid at 25° C. being available under the name Coasol™ from Chemoxy International, being a blend of the di-isobutyl esters of the glutaric, succinic and adipic acid. The advantage of the use of this component being the good dispersion in the adipic acid to provide flexibility. It should be noted that disintegration of the adipic acid is further improved by the adipate content of Coasol™.

According to a preferred embodiment of the invention, the coating comprises an acid having a melting temperature of at least 145° C., such as adipic acid for example, as well as a clay, such as a bentonite clay for example, whereby the clay is used as a disintegrant and also to render the structure of adipic acid more favourable for water penetration, thus improving the dispersion of the adipic acid in a aqueous medium. Preferred are clays present in the coating and having a particle size of less than 75 μm, more preferably of less than 53 μm, in order to obtain the desired effect on the structure of the acid. Preferred clays are bentonite clays. Indeed the acid has a melting point such that traditional cellulosic disintegrants undergo a thermal degradation during the coating process, whereas such clays are found to be more heat stable. Further, traditional cellulosic disintegrant such as Nymcel™ for example are found to turn brown at these temperatures.

In another preferred embodiment, the coating further comprises reinforcing fibres. Such fibres have been found to improve further the resistance of the coating to mechanical stress and minimise the splitting defect occurence. Such fibres are preferably having a length of at least 100 μm, more preferably of at least 200 μm and most preferably of at least 250 μm to allow structure reinforcement. Such fibres are preferably having a length of at less than 500 μm, more preferably of less than 400 μm and most preferably of less than 350 μm in order not to impact onto dispersion of the coating in an aqueous medium. Materials which may be used for these fibres include viscose rayon, natural nylon, synthetic nylon (polyamides types 6 and 6,6), acrylic, polyester, cotton and derivatives of cellulose such as CMCs. Most preferred is a cellulosic material available under the trade mark Solka-Floc™ from Fibers Sales & Development. It should be noted that such fibres do not normally need pre-compression for reinforcing the coating structure. Such fibres are preferably added at a level of less than 5% by weight of the coating, more preferably less than 3% by weight. Such fibres are preferably added at a level of more than 0.5% by weight of the coating, more preferably more than 1% by weight.

A coating of any desired thickness can be applied according to the present invention. For most purposes, the coating forms from 1% to 10%, preferably from 1.5% to 5%, of the tablet weight.

Tablet coatings are very hard and provide extra strength to the tablet.

Process

A preferred process for making a tablet according to the invention comprises the steps of:

(a) forming a core by compressing a particulate material, the particulate material comprising surfactant and detergent builder;

(b) applying a coating material to the core, the coating material being in the form of a melt;

(c) allowing the molten coating material to solidify; characterised in that the coating comprises a clay.

Another preferred process for making a tablet according to the invention comprises the steps of:

(a) forming a core by compressing a particulate material, the particulate material comprising surfactant and detergent builder;

(b) applying a coating material to the core, the coating material being dissolved in a solvent or water;

(c) allowing the solvent or water to evaporate; characterised in that the coating comprises a clay.

The compounds disclosed above for a product are advantageously packed in a packaging system.

A packaging system may be formed from a sheet of flexible material. Materials suitable for use as a flexible sheet include mono-layer, co-extruded or laminated films. Such films may comprise various components, such as poly-ethylene, polypropylene, poly-styrene, poly-ethylene-terephtalate. Preferably, the packaging system is composed of a poly-ethylene and bi-oriented-poly-propylene coextruded film with an MVTR of less than 5 g/day/$m^2$. The MVTR of the packaging system is preferably of less than 10 g/day/$m^2$, more preferably of less than 5 g/day/$m^2$. The film (2) may have various thicknesses. The thickness should typically be between 10 and 150 μm, preferably between 15 and 120 μm, more preferably between 20 and 100 μm, even more preferably between 25 and 80 μm and most preferably between 30 and 40 μm.

A packaging material preferably comprises a barrier layer typically found with packaging materials having a low oxygen transmission rate, typically of less than 300 $cm^3/m^2$/day, preferably of less than 150 $cm^3/m^2$/day, more preferably of less than 100 $cm^3/m^2$/day, even more preferably of less than 50 $cm^3/m^2$/day and most preferably of less than 10 $cm^3/m^2$/day. Typical materials having such barrier properties include bi oriented polypropylene, poly ethylene terephthalate, Nylon, poly(ethylene vinyl alcohol), or laminated materials comprising one of these, as well as SiOx (Silicium oxydes), or metallic foils such as aluminium foils for example. Such packaging material may have a beneficial influence on the stability of the product during storage for example.

Among the packing method used are typically the wrapping methods disclosed in WO92/20593, including flow wrapping or over wrapping. When using such processes, a longitudinal seal is provided, which may be a fin seal or an overlapping seal, after which a first end of the packaging system is closed with a first end seal, followed by closure of the second end with a second end seal. The packaging system may comprise re-closing means as described in WO92/20593. In particular, using a twist, a cold seal or an adhesive is particularly suited. Indeed, a band of cold seal or a band of adhesive may be applied to the surface of the packaging system at a position adjacent to the second end of the packaging system, so that this band may provide both the initial seal and re-closure of the packaging system. In such a case the adhesive or cold seal band may correspond to a region having a cohesive surface, i.e. a surface which will adhere only to another cohesive surface. Such re-closing means may also comprise spacers which will prevent unwanted adhesion. Such spacers are described in WO 95/13225, published on the 18th of May 1995. There may also be a plurality of spacers and a plurality of strips of adhesive material. The main requirement is that the communication between the exterior and the interior of the package should be minimal, even after first opening of the packaging system. A cold seal may be used, and in particular a grid of cold seal, whereby the cold seal is adapted so as to facilitate opening of the packaging system.

EXAMPLES

The following is a non-limiting example of a suitable perfume composition A which is used in the following non-limiting detergent tablet examples 1 and 2 according to the present invention:

| Perfume Component | % in Perfume Composition |
|---|---|
| Geraniol | 5.0 |
| Citronellol | 5.0 |
| 4 t-Butyl Cyclo Hexyl Acetate | 5.0 |
| Phenyl Ethyl Alcohol | 10.0 |
| Hexahydro-4,7-Methano-Inden-5-yl Acetate commercially available under the tradename Cyclacet | 6.0 |
| Citronellyl Acetate | 2.5 |
| Geranyl Acetate | 2.5 |
| Hexyl Cinnamic Aldehyde | 4.5 |
| Para Hydroxy Phenyl Butanone | 3.0 |
| PT Bucinal | 24.0 |
| Methyl Ionone | 10.0 |
| Rosalva | 2.0 |
| Methyl Dihydro Jasmonate | 7.0 |
| Undecylenic Aldehyde | 0.5 |
| Methyl Iso Butenyl Tetra Hydro Pyran | 1.0 |
| Ortho t Butyl Cyclo Hexyl Acetate | 6.0 |
| Hexyl Salicylate | 6.0 |
| Total | 100.0 |

Abbreviations Used in the Following Detergent Examples 1–6

In the detergent compositions, the abbreviated component identifications have the following meanings:

Anionic agglomerates 1 comprise of 40% anionic surfactant, 27% zeolite and 33% carbonate Anionic agglomerates 2 comprise of 40% anionic surfactant, 28% zeolite and 32% carbonate Nonionic agglomerate comprise 26% nonionic surfactant, 6% Lutensit K-HD 96, 40% Sodium acetate anhydrous, 20% carbonate and 8% zeolite.

Cationic agglomerates comprise of 20% cationic surfactant, 56% zeolite and 24% sulphate Layered silicate comprises of 95% SKS 6 and 5% silicate Bleach activator agglomerates comprise of 81% TAED, 17% acrylic/maleic copolymer (acid form) and 2% water.

Ethylene diamine N,N-disuccinic acid sodium salt/Sulphate particle comprise of 58% of Ethylene diamine N,N-disuccinic acid sodium salt, 23% of sulphate and 19% water.

Suds suppressor comprises of 11.5% silicone oil (ex Dow Corning); 59% of zeolite and 29.5% of water.

Binder spray-on system comprises 16% by weight of polymer of the following kind:

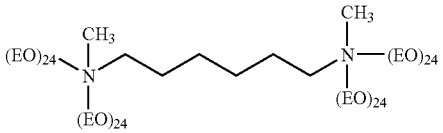

68% by weight of: PEG4000 and 16% by weight of: DIBS (Sodium di isoalkylbenzene sulphonate or Sodium toluene sulphonate).

Abbreviations Used in the Following Detergent Examples 7

In the detergent compositions, the abbreviated component identifications have the following meanings:

| | |
|---|---|
| LAS | Sodium linear $C_{11-13}$ alkyl benzene sulfonate |
| TAS | Sodium tallow alkyl sulfate |
| CxyAS | Sodium $C_{1x}$–$C_{1y}$ alkyl sulfate |
| C46SAS | Sodium $C_{14}$–$C_{16}$ secondary (2,3) alkyl sulfate |
| CxyEzS | Sodium $C_{1x}$–$C_{1y}$ alkyl sulfate condensed with z moles of ethylene oxide |
| CxyEz | $C_{1x}$–$C_{1y}$ predominantly linear primary alcohol condensed with an average of z moles of ethylene oxide |
| QAS | $R_2.N^+(CH_3)_2(C_2H_4OH)$ with $R_2 = C_{12}$–$C_{14}$ |
| QAS 1 | $R_2.N^+(CH_3)_2(C_2H_4OH)$ with $R_2 = C_8$–$C_{11}$ |
| SADS | Sodium $C_{14}$–$C_{22}$ alkyl disulfate of formula 2-(R).$C_4H_7$.-1,4-($SO_4$—)$_2$ where R = $C_{10}$–$C_{18}$ |
| SADE2S | Sodium $C_{14}$–$C_{22}$ alkyl disulfate of formula 2-(R).$C_4H_7$.-1,4-($SO_4$—)$_2$ where R = $C_{10}$–$C_{18}$, condensed with z moles of ethylene oxide |
| MES | x-sulpho methylester of $C_{18}$ fatty acid |
| APA | $C_8$–$C_{10}$ amido propyl dimethyl amine |
| Soap | Sodium linear alkyl carboxylate derived from an 80/20 mixture of tallow and coconut fatty acids |
| STS | Sodium toluene sulphonate |
| CFAA | $C_{12}$–$C_{14}$ (coco) alkyl N-methyl glucamide |
| TFAA | $C_{16}$–$C_{18}$ alkyl N-methyl glucamide |
| TPKFA | $C_{16}$–$C_{18}$ topped whole cut fatty acids |
| STPP | Anhydrous sodium tripolyphosphate |
| TSPP | Tetrasodium pyrophosphate |
| Zeolite A | Hydrated sodium aluminosilicate of formula $Na_{12}(A1O_2SiO_2)_{12}.27H_2O$ having a primary particle size in the range from 0.1 to 10 micrometers (weight expressed on an anhydrous basis) |
| NaSKS-6 | Crystalline layered silicate of formula δ-$Na_2Si_2O_5$ |
| Citric acid | Anhydrous citric acid |
| Borate | Sodium borate |
| Carbonate | Anydrous sodium carbonate with a particle size between 200 μm and 900 μm |
| Bicarbonate | Anhydrous sodium bicarbonate with a particle size distribution between 400 μm and 1200 μm |
| Silicate | Amorphous sodium silicate ($SiO_2$:$Na_2O$ = 2.0:1) |
| Sulfate | Anhydrous sodium sulfate |
| Mg sulfate | Anhydrous magnesium sulfate |
| Citrate | Tri-sodium citrate dihydrate of activity 86.4% with a particle size distribution between 425 μm and 850 μm |
| MA/AA | Copolymer of 1:4 maleic/acrylic acid, average molecular weight about 70,000 |
| MA/AA (1) | Copolymer of 4:6 maleic/acrylic acid, average molecular weight about 10,000 |
| AA | Sodium polyacrylate polymer of average molecular weight 4,500 |
| CMC | Sodium carboxymethyl cellulose |
| Cellulose ether | Methyl cellulose ether with a degree of polymerization of 650 available from Shin Etsu Chemicals |
| Protease | Proteolytic enzyme, having 3.3% by weight of active enzyme, sold by NOVO Industries A/S under the tradename Savinase |

-continued

| | |
|---|---|
| Protease I | Proteolytic enzyme, having 4% by weight of active enzyme, as described in WO 95/10591, sold by Genencor Int. Inc. |
| Alcalase | Proteolytic enzyme, having 5.3% by weight of active enzyme, sold by NOVO Industries A/S |
| Cellulase | Cellulytic enzyme, having 0.23% by weight of active enzyme, sold by NOVO Industries A/S under the tradename Carezyme |
| Amylase | Amylolytic enzyme, having 1.6% by weight of active enzyme, sold by NOVO Industries A/S under the tradename Termamyl 120T |
| Amylase II | Amylolytic enzyme, as disclosed in PCT/ U.S. Pat. No. 9,703,635 |
| Lipase | Lipolytic enzyme, having 2.0% by weight of active enzyme, sold by NOVO Industries A/S under the tradename Lipolase |
| Lipase II | Lipolytic enzyme, having 2.0% by weight of active enzyme, sold by NOVO Industries A/S under the tradename Lipolase Ultra |
| Endolase | Endoglucanase enzyme, having 1.5% by weight of active enzyme, sold by NOVO Industries A/S |
| PB4 | Sodium perborate tetrahydrate of nominal formula $NaBO_2.3H_2O.H_2O_2$ |
| PB1 | Anhydrous sodium perborate bleach of nominal formula $NaBO_2.H_2O_2$ |
| Percarbonate | Sodium percarbonate of nominal formula $2Na_2CO_3.3H_2O_2$ |
| DOBS | Decanoyl oxybenzene sulfonate in the form of the sodium salt |
| DPDA | Diperoxydodecanedioc acid |
| NOBS | Nonanoyloxybenzene sulfonate in the form of the sodium salt |
| NACA-OBS | (6-nonamidocaproyl) oxybenzene sulfonate |
| LOBS | Dodecanoyloxybenzene sulfonate in the form of the sodium salt |
| DOBS | Decanoyloxybenzene sulfonate in the form of the sodium salt |
| DOBA | Decanoyl oxybenzoic acid |
| TAED | Tetraacetylethylenediamine |
| DTPA | Diethylene triamine pentaacetic acid |
| DTPMP | Diethylene triamine penta (methylene phosphonate), marketed by Monsanto under the Tradename Dequest 2060 |
| EDDS | Ethylenediamine-N,N'-disuccinic acid, (S,S) isomer in the form of its sodium salt. |
| Photo-activated | Sulfonated zinc phthlocyanine encapsulated in bleach (1) dextrin soluble polymer |
| Photo-activated | Sulfonated alumino phthlocyanine encapsulated in bleach (2) dextrin soluble polymer |
| Brightener 1 | Disodium 4,4'-bis(2-sulphostyryl)biphenyl |
| Brightener 2 | Disodium 4,4'-bis(4-anilino-6-morpholino-1.3.5-triazin-2-yl)amino) stilbene-2:2'-disulfonate |
| HEDP | 1,1-hydroxyethane diphosphonic acid |
| PEGx | Polyethylene glycol, with a molecular weight of x (typically 4,000) |
| PEO | Polyethylene oxide, with an average molecular weight of 50,000 |
| TEPAE | Tetraethylenepentaamine ethoxylate |
| PVI | Polyvinyl imidasole, with an average molecular weight of 20,000 |
| PVP | Polyvinylpyrolidone polymer, with an average molecular weight of 60,000 |
| PVNO | Polyvinylpyridine N-oxide polymer, with an average molecular weight of 50,000 |
| PVPVI | Copolymer of polyvinylpyrolidone and vinylimidazole, with an average molecular weight of 20,000 |
| QEA | $bis((C_2H_5O)(C_2H_4O)_n)(CH_3)—N^+—C_6H_{12}—N^+—(CH_3)bis((C_2H_5O)—(C_2H_4O))_n$, wherein n = from 20 to 30 |
| PEI | Polyethyleneimine with an average molecular weight of 1800 and an average ethoxylation degree of 7 ethyleneoxy residues per nitrogen |
| Clay I | Bentonite clay |
| Clay II | Smectite clay |
| Flocculating agent I | polyethylene oxide of average molecular weight of between 200,000 and 400,000 |
| Flocculating agent II | polyethylene oxide of average molecular weight of between 400,000 and 1,000,000 |
| Flocculating agent III | polymer of acrylamide and/or acrylic acid of average molecular weight of 200,000 and 400,000 |

-continued

| | |
|---|---|
| SRP I | Anionically end-capped polyester soil release polymer |
| SRP II | Polysaccheride soil release polymer |
| SRP 1 | Nonionically end capped poly esters |
| SRP 2 | Diethoxylated poly (1,2 propylene terephtalate) short block polymer |
| Silicone antifoam | Polydimethylsiloxane foam controller with siloxane-oxyalkylene copolymer as dispersing agent with a ratio of said foam controller to said dispersing agent of 10:1 to 100:1 |
| Opacifier | Water based monostyrene latex mixture, sold by BASF Aktiengesellschaft under the tradename Lytron 621 |
| Wax | Paraffin wax |
| Speckle | Coloured carbonate salt or organic carboxylic acid/ salt |

Example 1 i) A detergent base powder of composition A was prepared as follows: all the particulate material of base composition were mixed together in a mixing drum or spray drum to form a homogenous particulate mixture, apart from the binder spray-on system, the fluorescer or brightener, and the photobleach Zinc Phthalocyanine sulphonate. The particulate mixture was thereafter divided in two equal parts, one part for making a white layer, another part for making a green layer. The white layer material is obtained by spraying the brightener or fluorescer together with half of the binder. The green layer material is obtained by spraying the photobleach Zinc Phthalocyanine sulphonate together with the rest of the binder. The layer where then processed independently in a Loedige KM 600®.

ii) Using a Bonals® rotary press both matrices were filled in two independent force feeding flasks. Both layers are compressed together in the precompression and compression stations to form a dual layer tablet.

iii) In this particular example, the tablets have a square cross section of 45 mm side, a height of 24 mm and a weight of 45 gr. The height of the green bottom layer corresponded to 50% of the total height of the tablet. The tensile strength of the uncoated tablets was 13 kpa.

iv) The tablet was thereafter coated with 2.5 g of coating formed from 89% by weight of adipic acid and 10% by weight of Bentonite clay from CSM, and 1% by weight of ethane 1-hydroxy diphosphonate.

| | Composition A (%) |
|---|---|
| Anionic agglomerates 1 | 9.1 |
| Anionic agglomerates 2 | 22.5 |
| Nonionic agglomerates | 9.1 |
| Cationic agglomerates | 4.6 |
| Layered silicate | 9.7 |
| Sodium percarbonate | 12.2 |
| Bleach activator agglomerates | 6.1 |
| Sodium carbonate | 7.67 |
| EDDS/Sulphate particle | 0.5 |
| Tetrasodium salt of Hydroxyethane Diphosphonic acid | 0.6 |
| Soil Release Polymer | 0.3 |
| Fluorescer | 0.2 |
| Zinc Phthalocyanine sulphonate | 0.03 |
| Soap powder | 1.2 |
| Suds suppressor | 2.8 |
| Citric acid | 5.5 |

-continued

| | Composition A (%) |
|---|---|
| Protease | 1 |
| Lipase | 0.35 |
| Cellulase | 0.2 |
| Amylase | 1.1 |
| Binder spray-on system | 4.75 |
| Perfume spray-on | 0.5 |

Example 2 i) A detergent base powder of composition A was prepared as follows: all the particulate material of base composition were mixed together in a mixing drum or spray drum to form a homogenous particulate mixture, apart from the binder spray-on system, the fluorescer or brightener, and the photobleach Zinc Phthalocyanine sulphonate. The particulate mixture was thereafter divided in two equal parts, one part for making a white layer, another part for making a green layer. The white layer material is obtained by spraying the brightener or fluorescer together with half of the binder. The green layer material is obtained by spraying the photobleach Zinc Phthalocyanine sulphonate together with the rest of the binder. The layer where then processed independently in a Loedige KM 600®.

ii) Using a Bonals® rotary press both matrices were filled in two independent force feeding flasks. Both layers are compressed together in the precompression and compression stations to form a dual layer tablet.

iii) In this particular example, the tablets have a square cross section of 45 mm side, a height of 24 mm and a weight of 45 gr. The height of the green bottom layer corresponded to 50% of the total height of the tablet. The tensile strength of the uncoated tablets was 13 kpa.

iv) The tablet was thereafter coated with 2.5 g of coating formed from 89% by weight of adipic acid and 10% by weight of Bentonite clay from CSM, and 0.5% by weight of ethane 1-hydroxy diphosphonate and 0.5% by weight of diethylene triamine penta (methylene phosphonate).

Example 3 i) A detergent base powder of composition A was prepared as follows: all the particulate material of base composition were mixed together in a mixing drum or spray drum to form a homogenous particulate mixture, apart from the binder spray-on system, the fluorescer or brightener, and the photobleach Zinc Phthalocyanine sulphonate. The particulate mixture was thereafter divided in two equal parts, one part for making a white layer, another part for making a green layer. The white layer material is obtained by spraying the brightener or fluorescer together with half of the binder. The green layer material is obtained by spraying the photobleach Zinc Phthalocyanine sulphonate together with the rest of the binder. The layer where then processed independently in a Loedige KM 600'.

ii) Using a Bonals® rotary press both matrices were filled in two independent force feeding flasks. Both layers are compressed together in the precompression and compression stations to form a dual layer tablet.

iii) In this particular example, the tablets have a square cross section of 45 mm side, a height of 24 mm and a weight of 45 gr. The height of the green bottom layer corresponded to 50% of the total height of the tablet. The tensile strength of the uncoated tablets was 13 kpa.

iv) The tablet was thereafter coated with 2.5 g of coating formed from 89% by weight of adipic acid and 10% by weight of Bentonite clay from CSM, and 0.5% by weight of ethane 1-hydroxy diphosphonate and 0.5% by weight of diethylene triamine penta (methylene phosphonate).

Example 4 i) A detergent base powder of composition A was prepared as follows: all the particulate material of base composition was mixed together in a mixing drum or spray drum to form a homogenous particulate mixture. The binder system was then sprayed on. The powder where then processed in a Loedige KM 600®.

ii) Using a Instron® Laboratory bench press, detergent powder was filled in the die. The powder had been compressed with a force so that the tensile strength of the tablet was 10 kpa.

iii) In this particular example, the tablets have a diameter of 54 mm side, a height of 24 mm and a weight of 45 gr.

iv) The tablet was thereafter coated with 2.5 g of coating formed from 90% by weight of Adipic acid and 10% by weight of bentonite clay from CSM.

The tablet was thereafter coated with 2.5 g of coating formed from 77% by weight of Adipic acid, 18.5% by weight of bentonite clay from and 1% by weight of Coa-Sol™ and 2.5% by weight of NaOH (1M), and 1% by weight of ethane 1-hydroxy diphosphonate.

Example 5 i) A detergent base powder of composition A was prepared as follows: all the particulate material of base composition were mixed together in a mixing drum or spray drum to form a homogenous particulate mixture. The binder system was then sprayed on. The powder where then processed in a Loedige KM 600®.

ii) Using a Instron® Laboratory bench press, detergent powder was filled in the die. The powder had been compressed with a force so that the tensile strength of the tablet was 10 kpa.

iii) In this particular example, the tablets have a diameter of 54 mm side, a height of 24 mm and a weight of 45 gr.

The tablet was thereafter coated with 2.5 g of coating formed from 88% by weight of Adipic acid, 10% by weight of bentonite clay from and 1% of Coasol™, and 1% by weight of ethane 1-hydroxy diphosphonate.

Example 6 i) A detergent base powder of composition A was prepared as follows: all the particulate material of base composition were mixed together in a mixing drum or spray drum to form a homogenous particulate mixture. The binder system was then sprayed on. The powder where then processed in a Loedige KM 600'.

ii) Using a Instron® Laboratory bench press, detergent powder was filled in the die. The powder had been compressed with a force so that the tensile strength of the tablet was 10 kpa.

iii) In this particular example, the tablets have a diameter of 54 mm side, a height of 24 mm and a weight of 45 gr.

iv) The tablet was thereafter coated with 2.5 g of coating formed from 86% by weight of Adipic acid, 10% by weight of bentonite clay from and 1% by weight of Coasol™ and 2% by weight of Solka-Floc™ 1016, and 0.5% by weight of ethane 1-hydroxy diphosphonate and 0.5% by weight of diethylene triamine penta (methylene phosphonate).

Example 7

The following are detergent compositions according to the invention which may be used as is or in place of Composition A, above described, in any one of Examples 1–6.

In the following examples all levels are quoted as % by weight of the composition:

| | B | C | D | E |
|---|---|---|---|---|
| Blown powder | | | | |
| Clay I or II | 7.0 | 10.0 | 6.0 | 2.0 |
| Flocculating agent I or II | 0.3 | 1.0 | 1.0 | 0.5 |
| LAS | 16.0 | 5.0 | 11.0 | 6.0 |
| TAS | — | 5.0 | — | 2.0 |
| Zeolite A | — | 20.0 | — | 10.0 |
| STPP | 24.0 | — | 14.0 | — |
| Sulfate | — | 2.0 | — | — |
| MA/AA | — | 2.0 | 1.0 | 1.0 |
| Silicate | 4.0 | 7.0 | 3.0 | — |
| CMC | 1.0 | — | 0.5 | 0.6 |
| Brightener | 0.2 | 0.2 | 0.2 | 0.2 |
| Sodium carbonate | 10.0 | 10.0 | 20.0 | — |
| DTPMP | 0.4 | 0.4 | 0.2 | — |
| Spray on | | | | |
| Brightener | 0.02 | — | — | 0.02 |
| C45E7 or E9 | — | — | 2.0 | 1.0 |
| C45E3 or E4 | — | — | 2.0 | 4.0 |
| Perfume | 0.5 | — | 0.5 | 0.2 |
| Silicone antifoam | 0.3 | — | — | — |
| Dry additives | | | | |
| QEA | — | — | — | 1.0 |
| HEDP/EDDS | 0.3 | — | — | — |
| Sulfate | 2.0 | — | — | — |
| Carbonate | 20.0 | 13.0 | 15.0 | 24.0 |
| Citric acid | 2.5 | — | — | 2.0 |
| QAS | — | — | 0.5 | 0.5 |
| SKS-6 | 3.5 | — | — | 5.0 |
| Percarbonate | — | — | — | 9.0 |
| PB4 | — | — | 5.0 | |
| NOBS | — | — | — | 1.3 |
| TAED | — | — | 2.0 | 1.5 |
| Protease | 1.0 | 1.0 | 1.0 | 1.0 |
| Lipase | — | 0.4 | — | 0.2 |
| Amylase | 0.2 | 0.2 | 0.2 | 0.4 |
| Brightener | 0.05 | — | — | 0.05 |
| Perfume | 1.0 | 0.2 | 0.5 | 0.3 |
| Speckle | 1.2 | 0.5 | 2.0 | — |
| Misc/minor to 100% | | | | |

The following are compositions suitable for use herein

| | F | G | H | I | J | K | L |
|---|---|---|---|---|---|---|---|
| Sodium $C_{11}$–$C_{13}$ alkylbenzenesulfonate | 12.0 | 16.0 | 23.0 | 19.0 | 18.0 | 20.0 | 16.0 |
| Sodium $C_{14}$–$C_{15}$ alcohol sulfate | | 4.5 | — | | — | — | 4.0 |
| $C_{14}$–$C_{15}$ alcohol ethoxylate (0.5) sulfate | | | — | — | — | — | — |
| $C_{14}$–$C_{15}$ alcohol ethoxylate (3) sulfate | — | — | 2.0 | — | 1.0 | 1.0 | 1.0 |
| Sodium $C_{14}$–$C_{15}$ alcohol ethoxylate | 2.0 | 2.0 | — | 1.3 | — | — | 5.0 |

-continued

| | F | G | H | I | J | K | L |
|---|---|---|---|---|---|---|---|
| $C_9$–$C_{14}$ alkyl dimethyl hydroxy ethyl quaternary ammonium salt | | | — | — | 1.0 | 0.5 | 2.0 |
| Tallow fatty acid | | | — | — | — | — | 1.0 |
| Tallow alcohol ethoxylate (50) | — | — | — | — | — | — | — |
| Sodium tripoly-phosphate/Zeolite | 23.0 | 25.0 | 14.0 | 22.0 | 20.0 | 10.0 | 20.0 |
| Sodium carbonate | 25.0 | 22.0 | 35.0 | 20.0 | 28.0 | 41.0 | 30.0 |
| Sodium Polyacrylate (45%) | 0.5 | 0.5 | 0.5 | 0.5 | — | — | — |
| Sodium polyacrylate/maleate polymer | — | — | 1.0 | 1.0 | 1.0 | 2.0 | 0.5 |
| Sodium silicate (1:6 ratio $NaO/SiO_2$) (46%) | 3.0 | 6.0 | 9.0 | 8.0 | 9.0 | 6.0 | 8.0 |
| Sodium sulfate | — | — | — | — | — | 2.0 | 3.0 |
| Sodium perborate/ percarbonate | 5.0 | 5.0 | 10.0 | — | 3.0 | 1.0 | — |
| Poly(ethyleneglycol), MW ~4000 (50%) | 1.5 | 1.5 | 1.0 | 1.0 | — | — | 0.5 |
| Sodium carboxy methyl cellulose | 1.0 | 1.0 | 1.0 | — | 0.5 | 0.5 | 0.5 |
| Citric acid | — | — | — | — | — | — | — |
| NOBS/DOBS | — | 1.0 | — | — | 1.0 | 0.7 | — |
| TAED | 1.5 | 1.0 | 2.5 | — | 3.0 | 0.7 | — |
| SRP | 1.5 | 1.5 | 1.0 | 1.0 | — | 1.0 | — |
| Clay I or II | 5.0 | 6.0 | 12.0 | 7.0 | 10.0 | 4.0 | 3.0 |
| Flocculating agent I or III | 0.2 | 0.2 | 3.0 | 2.0 | 0.1 | 1.0 | 0.5 |
| Humectant | 0.5 | 1.0 | 0.5 | 1.0 | 0.5 | 0.5 | — |
| Wax | 0.5 | 0.5 | 1.0 | — | — | 0.5 | 0.5 |
| Moisture | 7.5 | 7.5 | 6.0 | 7.0 | 5.0 | 3.0 | 5.0 |
| Magnesium sulphate | — | — | — | — | — | 0.5 | 1.5 |
| Chelant | — | — | — | — | 0.8 | 0.6 | 1.0 |
| Enzymes, including amylase, cellulase, protease and lipase | — | — | — | — | 2.0 | 1.5 | 2.0 |
| Speckle | 2.5 | 4.1 | 4.2 | 4.4 | 5.6 | 5.0 | 5.2 |
| minors, e.g. perfume, PVP, PVPVI/PVNO, brightener, photo-bleach, | 2.0 | 1.0 | 1.0 | 1.0 | 2.5 | 1.5 | 1.0 |

The following are detergent compositions suitable for use herein

| | M | N | O | P |
|---|---|---|---|---|
| Sodium $C_{11}$–$C_{13}$ alkylbenzenesulfonate | 23.0 | 13.0 | 20.0 | 18.0 |
| Sodium $C_{14}$–$C_{15}$ alcohol sulfate | — | 4.0 | — | — |
| Clay I or II | 5.0 | 10.0 | 14.0 | 6.0 |
| Flocculating agent I or II | 0.2 | 0.3 | 0.1 | 0.9 |
| Wax | 0.5 | 0.5 | 1.0 | — |
| Humectant (glycerol/silica) | 0.5 | 2.0 | 1.5 | — |
| $C_{14}$–$C_{15}$ alcohol ethoxylate sulfate | — | | — | 2.0 |
| Sodium $C_{14}$–$C_{15}$ alcohol ethoxylate ( | 2.5 | 3.5 | — | — |
| $C_9$–$C_{14}$ alkyl dimethyl hydroxy ethyl quaternary ammonium salt | | — | — | 0.5 |
| Tallow fatty acid | 0.5 | — | — | — |
| Tallow alcohol ethoxylate (50) | — | — | | 1.3 |
| Sodium tripolyphosphate | — | 41.0 | — | 20.0 |
| Zeolite A, hydrate (0.1–10 micron size) | 26.3 | — | 21.3 | — |
| Sodium carbonate | 24.0 | 22.0 | 35.0 | 27.0 |
| Sodium Polyacrylate (45%) | 2.4 | — | 2.7 | — |
| Sodium polyacrylate/maleate polymer | — | — | 1.0 | 2.5 |
| Sodium silicate (1.6 or 2 or 2.2 ratio $NaO/SiO_2$)(46%) | 4.0 | 7.0 | 2.0 | 6.0 |
| Sodium sulfate | — | 6.0 | 2.0 | — |
| Sodium perborate/percarbonate | 8.0 | 4.0 | — | 12.0 |
| Poly(ethyleneglycol), MW ~4000 50%) | 1.7 | 0.4 | 1.0 | — |

-continued

| | M | N | O | P |
|---|---|---|---|---|
| Sodium carboxy methyl cellulose | 1.0 | — | — | 0.3 |
| Citric acid | — | — | 3.0 | — |
| NOBS/DOBS | 1.2 | — | — | 1.0 |
| TAED | 0.6 | 1.5 | — | 3.0 |
| Perfume | 0.5 | 1.0 | 0.3 | 0.4 |
| Soil release polymer | — | 1.5 | 1.0 | 1.0 |
| Moisture | 7.5 | 3.1 | 6.1 | 7.3 |
| Magnesium sulphate | — | — | — | 1.0 |
| Chelant | — | — | — | 0.5 |
| speckle | 1.0 | 0.5 | 0.2 | 2.7 |
| Enzymes, including amylase, cellulase, protease and lipase | — | 1.0 | — | 1.5 |
| minors, e.g. brightener, photo-bleach | 1.0 | 1.0 | 1.0 | 1.0 |

The following are detergent compositions suitable for use herein

| | Q | R | S | T | U |
|---|---|---|---|---|---|
| Blown Powder | | | | | |
| STPP/Zeolite A | 9.0 | 15.0 | 15.0 | 9.0 | 9.0 |
| Flocculating agent II or III | 0.5 | 0.2 | 0.9 | 1.5 | — |
| LAS | 7.5 | 23.0 | 3.0 | 7.5 | 7.5 |
| QAS | 2.5 | 1.5 | — | — | — |
| DTPMP | 0.4 | 0.2 | 0.4 | 0.4 | 0.4 |
| HEDP or EDDS | — | 0.4 | 0.2 | — | — |
| CMC | 0.1 | 0.4 | 0.4 | 0.1 | 0.1 |
| Sodium carbonate | 5.0 | 20.0 | 20.0 | 10.0 | — |
| Brightener | 0.05 | — | — | 0.05 | 0.05 |
| Clay I or II | — | 10.0 | — | — | — |
| STS | 0.5 | — | — | 0.5 | 0.5 |
| MA/AA | 1.5 | 2.0 | 2.0 | 1.5 | 1.5 |
| Agglomerates | | | | | |
| Suds suppresser (silicon) | 1.0 | 1.0 | — | 2.0 | 0.5 |
| Agglomerate | | | | | |
| Clay | 9.0 | — | — | 4.0 | 10.0 |
| Wax | 0.5 | — | — | 0.5 | 1.5 |
| Glycerol | 0.5 | — | — | 0.5 | 0.5 |
| Agglomerate | | | | | |
| LAS | — | 5.0 | 5.0 | — | — |
| TAS | — | 2.0 | 1.0 | — | — |
| Silicate | — | 3.0 | 4.0 | — | — |
| Zeolite A | — | 8.0 | 8.0 | — | — |
| Carbonate | — | 8.0 | 4.0 | — | — |
| Spray On | | | | | |
| Perfume | 0.3 | — | — | 0.3 | 0.3 |
| C45E7 or E9 | 2.0 | — | — | 2.0 | 2.0 |
| C25E3 or E4 | 2.0 | — | — | 2.0 | 2.0 |
| Dry additives | | | | | |
| Citrate or citric acid | 2.5 | — | 2.0 | 2.5 | 2.5 |
| Clay I or II | — | 5.0 | 5.0 | — | — |
| Flocculating agent I or II | — | — | — | — | 0.2 |
| Bicarbonate | — | 3.0 | — | — | — |
| Carbonate | 15.0 | — | — | 25.0 | 31.0 |
| TAED | 1.0 | 2.0 | 5.0 | 1.0 | — |
| Sodium perborate or percarbonate | 6.0 | 7.0 | 10.0 | 6.0 | — |
| SRP I, II or III | 0.2 | 0.1 | 0.2 | 0.5 | 0.3 |
| CMC or nonionic cellulose ether | 1.0 | 1.5 | 0.5 | — | — |
| Protease | 0.3 | 1.0 | 1.0 | 0.3 | 0.3 |
| Lipase | — | 0.4 | 0.4 | — | — |
| Amylase | 0.2 | 0.6 | 0.6 | 0.2 | 0.2 |
| Cellulase | 0.2 | 0.6 | 0.6 | 0.2 | 0.2 |
| Silicone antifoam | — | 5.0 | 5.0 | — | — |

-continued

| | Q | R | S | T | U |
|---|---|---|---|---|---|
| Perfume (starch) | 0.2 | 0.3 | 1.0 | 0.2 | 0.2 |
| Speckle | 0.5 | 0.5 | 0.1 | — | 1.0 |
| SKS-6 (silicate 2R) | 3.5 | — | — | — | 3.5 |
| Photobleach | 0.1 | — | — | 0.1 | 0.1 |
| Soap | 0.5 | 2.5 | — | 0.5 | 0.5 |
| Sodium sulfate | — | 3.0 | — | — | — |
| Misc/minors to 100% | 100.0 | 100.0 | 100.0 | 100.0 | 100.0 |
| Density (g/litre) | 850 | 850 | 850 | 850 | 850 |

What is claimed is:

1. A perfumed detergent tablet, the tablet comprising a clay mineral compound, and a perfume composition that is substantially free of Schiff base and wherein said tablet further comprises a heavy metal ion sequestrant coating from 0.5% to 5% by weight of the tablet and wherein said heavy metal ion sequestrant comprises alkali metal ethane 1-hydroxy diphosphonates: ethylenediamine-N,N'-disuccinic acid (EDDS); $Na_2EDDS$; $Na_3EDDS$; MgEDDS $Mg_2EDDS$; iminodiacetic acid derivatives; ethylenetriamine pentaacetic acid; ethylenediamine disuccinic acid; ethylenediamine diglutaric acid; 2-hydroxypropylenediamine disuccinic acid; amino alkylene poly (alkylene phosphonates); nitrilo trimethylene phosphonates; iminodiacetic acid-N-2-hydroxypropyl sulfonic acid; aspartic acid N-carboxymethyl N-2-hydroxypropyl-3-sulfonic acid; β-alanine-N-N'-diacetic acid; aspartic acid-N,N'-diacetic acid; aspartic acid-N-monoacetic acid; iminodisuccinic acid, the alkali metal, alkaline earth metal, ammonium, or substituted ammonium salts thereof.

2. A tablet according to claim 1, wherein the clay mineral compound is present in the coating as particles that have a size below 75 μm diameter.

3. A tablet according to claim 1, wherein the tablet is a softening tablet.

4. A tablet according to claim 1, wherein the perfume composition is free of perfume ingredient mixtures selected from the group consisting of Methyl Anthranilate and HydroxyCitronellal; Methyl Anthranilate and Methyl Nonyl Acetaldehyde; Methyl Anthranilate and PT Bucinal; Methyl anthranilate and Lyral; Methyl Anthranilate and Ligustral; and mixtures thereof.

5. A tablet according to claim 1, wherein the coating further comprises an acid having a melting temperature of at least 40° C.

6. A tablet according to claim 5, wherein the acid having a melting temperature of at least 40° C. has a crystallized structure.

7. A tablet according to claim 6, wherein the acid forming the crystallized structure is a dicarboxylic acid.

8. A tablet according to claim 7, wherein the dicarboxylic acid is adipic acid.

9. A tablet according to claim 1, wherein the coating further comprises a component which is liquid at 25° C.

10. A tablet according to claim 1, wherein the coating further comprises reinforcing fibers.

11. A tablet according to claim 1, further comprising a flocculating agent.

* * * * *